US007052005B2

(12) United States Patent
Yamakawa et al.

(10) Patent No.: US 7,052,005 B2
(45) Date of Patent: May 30, 2006

(54) SHEET POSTPROCESSING APPARATUS FOR USE WITH IMAGE FORMING APPARATUS AND FOLDING METHOD

(75) Inventors: Mikihiro Yamakawa, Tokyo (JP); Toshio Shida, Tokyo (JP); Masahiro Kaneko, Tokyo (JP)

(73) Assignee: Konica Corporation (JP)

( * ) Notice: Subject to any disclaimer, the term of this patent is extended or adjusted under 35 U.S.C. 154(b) by 243 days.

(21) Appl. No.: 10/452,977

(22) Filed: Jun. 2, 2003

(65) Prior Publication Data

US 2003/0227121 A1 Dec. 11, 2003

(30) Foreign Application Priority Data

Jun. 7, 2002 (JP) ..... 2002-166680
Jun. 14, 2002 (JP) ..... 2002-174128
Jun. 21, 2002 (JP) ..... 2002-181449

(51) Int. Cl.
*B65H 37/04* (2006.01)

(52) U.S. Cl. ..... 270/37; 493/442; 493/435; 493/443

(58) Field of Classification Search ..... 270/32, 270/37, 45, 51, 442, 443, 446, 447, 392, 270/351, 390; 493/442, 443, 446, 447, 392, 493/351, 390, 434, 435
See application file for complete search history.

(56) References Cited

U.S. PATENT DOCUMENTS 4,403,981 A * 9/1983 Wuthrich ..... 493/419
4,717,134 A * 1/1988 Iida et al. ..... 270/39.01
5,076,556 A * 12/1991 Mandel ..... 270/45
6,006,065 A * 12/1999 Seki ..... 399/407
6,042,529 A * 3/2000 Hubler et al. ..... 493/434
6,592,506 B1 * 7/2003 Lyga ..... 493/424
6,730,010 B1 * 5/2004 Yamakawa et al. ..... 493/267

FOREIGN PATENT DOCUMENTS

JP 2003063736 A * 3/2003
JP 2003276939 A * 10/2003

* cited by examiner

*Primary Examiner*—Patrick Mackey
(74) *Attorney, Agent, or Firm*—Squire, Sanders & Dempsey L.L.P.

(57) ABSTRACT

This invention relates to a sheet postprocessing apparatus for executing postprocessing including a punching process, folding process, binding process, and the like, midway along a sheet convey path, for sheets discharged from an image forming apparatus, and a folding method. This sheet postprocessing apparatus includes a sheet folding section having the first and second folding sections which are arranged in series in a sheet convey direction to execute folding processes for sheets. The sheet folding section is configured such that the first folding section performs the first folding process in a Z-fold process, the first folding process in an internal three-fold process, and a center folding process with an image-transferred surface facing outside, and the second folding section performs the second folding process in the Z-fold process, the second folding process in the internal three-fold process, and a center folding process with an image-transferred surface facing inside.

14 Claims, 22 Drawing Sheets

SHEET POSTPROCESSING APPARATUS FOR USE WITH IMAGE FORMING APPARATUS AND FOLDING METHOD

BACKGROUND OF THE INVENTION

1. Field of the Invention

The present invention relates to a sheet postprocessing apparatus which applies postprocessing such as a punching process, binding process, and folding process to a sheet (to be also referred to as a recording sheet or transfer sheet) discharged from an image forming apparatus such as an electrophotographic copying machine, a printer, a facsimile apparatus, or a composite apparatus having functions equivalent to them after an image is transferred/formed on the sheet by the image forming apparatus.

2. Description of the Prior Art

There has been provided a sheet postprocessing apparatus which performs postprocessing such as a punching process, folding process, and binding process for a sheet onto which an image is transferred by an image forming apparatus such as a copying machine, a printer, a facsimile apparatus, or a composite apparatus of them. This sheet postprocessing apparatus is driven upon being connected to the print function of an image forming apparatus.

In the sheet postprocessing apparatus disclosed in Japanese Unexamined Patent Publication No. 2001-72321, the sheet bundle center folding section for center-folding a plurality of sheets executes a Z-fold process, internal three-fold process, center folding process, or the like for one sheet.

In the sheet postprocessing apparatus disclosed in Japanese Unexamined Patent Publication No. 2001-261220, the first postprocessing section executes a Z-fold process for one sheet, and the second postprocessing section located downstream of the binding section executes a center folding process for a plurality of sheets, and an internal three-fold process, a center folding process, or the like for one sheet.

As the conventional postprocessing apparatuses, there is a postprocessing apparatus, as shown in FIG. 1, in which some kinds of folding processes such as, for example, a center folding, three-fold, Z-fold, etc., are applied on the transfer sheet on which an image is formed by an image forming apparatus.

FIG. 1 is a longitudinal sectional view showing the arrangement of the main part of a conventional sheet postprocessing apparatus. The sheet postprocessing apparatus 60 is connected to an image forming apparatus, not shown, by disposing the sheet postprocessing apparatus so as to facing an inlet guide plate 621 for introducing a transfer sheet S into an inlet 62 of the sheet postprocessing apparatus to a discharg roller 61 for discharging the transfer sheet S on which an image is formed by the image forming apparatus.

In the vicinity of the inlet 62, a sensor PS1 for detecting leading and trailing ends of the transfer sheet S and a punching means 63 are arranged. In the downstream of the punching means 63, a resist roller 64 for correcting a position of the transfer sheet S. In a further forward portion thereof, a switching member 69 for switching a convey path of the transfer sheet S is so arranged as to be swingable by the action of a solenoid SD1.

On the upper side of the switching member 69, folding rollers 651, 652 and 653 are mounted such that pairs of folding rollers 651, 652 and 652, 653 abuts with each other under pressure, respectively. On the upper side of the folding rollers 651, 652 and 653, a first stopper means 66 is arranged. The first stopper means 66 consists of a pair of rollers and an endless belt wound over these rollers, and is driven by a motor M1 connected to one of the pair of rollers. To the endless belt, a collision member 661 is fixed so as not to move forwardly the transfer sheet S over the collision member 661.

On the lower side of the folding roller 653, there is provided a second stopper means 67 consisting of a pair of rollers, which have different diameters from each other, and an endless belt wound over the pair of rollers, and driven by a motor M2 connected to one of these rollers having a small diameter. The endless belt of the second stopper means 67 has a collision member 671 also. On the downstream side of the second stopper means 67, there is a provided a discharge roller 68 for discharging the transfer sheet S outside the sheet postprocessing apparatus 60.

In FIGS. 2A to 2C, operation steps for applying a Z-fold process by making use of the sheet postprocessing apparatus 60 are shown in order. In FIG. 2A, the transfer sheet S transferred from the image forming apparatus, not shown, is further transferred toward the first stopper means 66 by the action of the switching member 69 after correcting its position in cooperation with the resist roller 64. The leading end of the transfer sheet S is stopped by colliding with the collision member 61, but the resist roller 64 continuously rotates so as to further transfer the transfer sheet S. As a result, the transfer sheet S itself causes a first deflection in the vicinity of the folding rollers 651, 652. Further, when the trailing end portion of the transfer sheet S is continuously transferred, the transfer sheet S is rolled in a nip point N4 between the folding rollers 651 and 652 so as to form a fold e.

By rotating continuously the fold rollers 651, 652 in the direction of the arrows in FIG. 2A, the fold e is stopped by colliding with the collision member 671 of the second stopper means 67, as shown in FIG. 2B. Then, the transfer sheet S itself causes a second deflection when the fold rollers 651, 652 continue rotating. As a result, the transfer sheet S is rolled in a nip point N5 between the folding rollers 652 and 653 so as to form a fold f. Thus, the Z-fold process is completed.

In FIG. 2C, the transfer sheet S on which the fold f is formed is transferred again to the second stopper means 67 after turning around the periphery of the folding roller 653. At that time, the collision member 671 is moved by the action of the motor M2 shown in FIG. 1 to a position where a convey path toward the discharge roller 68 is opened. Therefore, the transfer sheet S on which the Z-fold process is applied can be discharged outside by the discharge roller 68.

Since the collision members 661, 671 can be freely displaced by the endless belt, it becomes possible to apply other folding processes except the Z-fold process such as, for example, a three-fold process, a center folding process, etc., to the transfer sheet S.

However, in the above-described conventional postprocessing apparatus 60, there is a problem such that a folding position is not stable because, dependent on the size of the transfer sheet S, the distance between the collision member 661 and the nip point N4 shown in FIG. 2A and the distance between the nip point N5 shown in FIG. 2B and the collision member 671 becomes long.

In order to overcome this problem, such an improved folding section as having two pairs of folding rollers and trailing rollers each abutted against the folding roller under pressure in which the two folding rollers are abutted against each other under pressure has been invented. According to the folding section, it becomes possible to attain a precise folding position and a stable folding process.

In the improved conventional postprocessing apparatus, two improved folding sections are arranged at a first folding section where a first folding process is applied to the transfer sheet S and at a second folding section where a second folding process is applied thereto. In case of applying the Z-fold process, the first folding process is applied to a predetermined position of the transfer sheet S at the first folding section, and then the second folding process is applied to the transfer sheet S, to which the first folding process has been applied, at the second folding section.

In FIGS. 3A and 3B, operation steps of second folding process in the Z-fold process by making use of the second folding section of the improved sheet postprocessing apparatus are shown in order.

The transfer sheet S is transferred from the first folding section, not shown, in the direction of the arrow T under the condition that a fold back portion of the transfer sheet S faces the folding rollers 91 and 92, and then stopped at a position corresponding to a half of the whole original length of the transfer sheet S by the cooperation of a sensor, not shown. As shown in the FIG. 3A, the transfer sheet S is subjected to buckling when the pairs of the folding rollers 91, 92 and the trailing rollers 93, 94 abutted against the folding rollers, respectively, are allowed to rotate in the directions of arrows, and advanced toward the nip point n.

At that time, as shown in FIG. 3B, only the leading end t of the fold back portion S' folded in the first folding section firstly passes through the nip point n, and thereafter a deflection portion b of the transfer sheet S is rolled in the nip point n. As a result, when the second folding process is continued under this condition, the transfer sheet S is folded in the state that the leading end t is remarkably shifted from the fold b. Accordingly, such a phenomenon as called multiple folding is generated, so that the folding position is not stable.

The following problems are posed in these conventional sheet postprocessing apparatuses for performing folding processes.

(1) When the sheet bundle center folding section for performing a center folding process is to execute a folding process such as a Z-fold process, internal three-fold process, or center folding process for one sheet after a plurality of sheets are bound, excessive pressing force produced by a pair of folding rollers in tight contact with each other may be exerted on one sheet to produce creases on the sheet or damage it. When a folding plate is inserted between the pair of folding rollers in tight contact with a sheet being clamped between the rollers, the folding plate may damage the fold of the sheet. In addition, since a folding process such as an internal three-fold process or center folding process for one sheet is executed after the sheet is conveyed to the sheet bundle center folding section located downstream of the binding section, a sheet convey failure tends to occur on a long, bent sheet convey path.

(2) Consider a case wherein the first postprocessing section executes only a Z-fold process, and the second postprocessing section executes a center folding process for a plurality of sheets and a folding process such as an internal three-fold process or a center folding process for one sheet. In this case as well, when a folding process such as an internal three-fold process or center folding process is to be performed for one sheet, excessive pressing force produced by the pair of folding rollers in tight contact with each other may be exerted on one sheet to produce creases on the sheet or damage it. In addition, when the folding plate is inserted between the pair of folding rollers in tight contact with each other with a sheet being clamped between the rollers, the folding plate may damage the fold of the sheet. Furthermore, since a folding process such as an internal three-fold process or center folding process for one sheet is executed after the sheet is conveyed to the sheet bundle center folding section located downstream of the binding section, a sheet convey failure tends to occur on a long, bent sheet convey path.

(3) In the conventional sheet postprocessing apparatus, since sheets for which no folding process such as a Z-fold process, internal three-fold process, or center folding process is to be executed pass through the folding section, a sheet convey failure tends to occur in the folding section.

SUMMARY OF THE INVENTION

The present invention has been made in view of the foregoing circumstances in the prior art and has for its first object to provide a space-saving sheet postprocessing apparatus, which can selectively process a transfer sheet discharged from an image forming apparatus either a sheet to be subjected to one of four types of folding processes, i.e., a Z-fold process, an internal three-fold process, a center folding process with an image-transferred surface facing outside, and a center folding process with an image-transferred surface facing inside, or a sheet subjected to straight paper discharge, i.e., discharging the sheet without any folding process.

It is a second object of the present invention to provide a sheet postprocessing apparatus, which can prevent damage to transfer sheets and the folds of the sheets, because folding processes applied to the sheets can be done without using any folding knife, and which can improve the quality of folded sheets in appearance.

It is a third object of the present invention to provide a sheet postprocessing apparatus, which can prevent the multiple folding of the transfer sheet, in particular, that caused in applying the second folding process in a Z-fold process, because it becomes possible to form a stable fold at a desired position of the transfer sheet.

It is a fourth object of the present invention to provide a folding method which can perform a stable folding process, and which can prevent the multiple folding of the transfer sheet.

In order to achieve the above objects, according to the first aspect of the present invention, there is provided a sheet postprocessing apparatus which executes postprocessing including a punching process, a folding process, and a binding process midway along a sheet convey path for a sheet on which an image is transferred/formed by an image forming apparatus and which is discharged from the image forming apparatus, comprising a sheet folding section having first and second folding sections which are arranged in series in a sheet convey direction to execute the folding process for the sheet, wherein the sheet folding section is configured such that the first folding section performs a first folding process in a Z-fold process, a first folding process in an internal three-fold process, and a center folding process with an image-transferred surface facing outside and the second folding section performs a second folding process in the Z-fold process, a second folding process in the internal three-fold process, and a center folding process with an image-transferred surface facing inside.

According to the second aspect of the present invention, there is provided the sheet postprocessing apparatus described in the first aspect, wherein the sheet discharged from the image forming apparatus is guided to the sheet postprocessing apparatus, with the image-transferred surface facing down, while being reversed back to front with respect to the sheet when the image is formed thereon, the first folding section folds the sheet with the image-transferred surface facing outside, and the second folding section folds the sheet with the image-transferred surface facing inside.

According to the third aspect of the present invention, there is provided the sheet postprocessing apparatus described in the first or second aspect, wherein each of the first and second folding sections comprises a pair of folding rollers which rotate in tight contact with each other, a driven roller which is detachably brought into tight contact with one of the pair of folding rollers to be driven/rotated, a driven roller which is brought into tight contact with the other of the pair of folding rollers to be driven/rotated, and a sensor which detects passage of a leading end portion of a sheet guided into the folding section.

According to the fourth aspect of the present invention, there is provided the sheet postprocessing apparatus described in the third aspect, wherein the centers of the two driven rollers are located inside the centers of the pair of folding rollers.

According to the fifth aspect of the present invention, there is provided the sheet postprocessing apparatus described in any of the first to third aspects, wherein the two driven rollers are mounted on a support shaft through rolling bearings, respectively.

According to the sixth aspect of the present invention, there is provided the sheet postprocessing apparatus described in the first aspect, wherein the sheet postprocessing apparatus includes a convey path on which the sheet passes through the sheet folding section constituted by the first and second folding sections and a bypass convey path on which the sheet does not pass through the sheet folding section.

According to the seventh aspect of the present invention, there is provided the sheet postprocessing apparatus described in the sixth aspect, wherein the sheet which has passed the bypass convey path is conveyed to a sheet mount base disposed downstream of the sheet folding section in the sheet convey direction.

According to the eighth aspect of the present invention, there is provided a sheet postprocessing apparatus which executes postprocessing including a punching process, a folding process, and a binding process midway along a sheet convey path for a sheet on which an image is transferred/formed by an image forming apparatus and which is discharged from the image forming apparatus, comprising a sheet folding section including first and second folding sections which perform folding processes for a sheet discharged from the image forming apparatus, a binding section which is disposed on a sheet convey path located downstream of the first folding section and upstream of the second folding section in a sheet convey direction, on which a sheet bundle constituted by a plurality of sheets is stacked, aligned, and subjected to a binding process, and control means for controlling driving operation of the first and second folding sections, wherein the first folding section includes a pair of folding rollers which rotate in tight contact with each other, a driven roller which is detachably brought into tight contact with one of the pair of folding rollers to be driven/rotated, a driven roller which is brought into tight contact with the other of the pair of folding rollers to be driven/rotated, and a sensor which detects passage of a leading end portion of a sheet guided into the first folding section, the second folding section includes a folding plate member which can be moved in a direction perpendicular to a sheet surface, and a pair of folding rollers which are in tight contact with each other, and when an internal three-fold process is set for a sheet, the control means performs control to convey the sheet while releasing tight contact between an upstream driven roller which opposes an upstream folding roller of the pair of folding rollers of the first folding section, stop the sheet at a first predetermined position on the basis of a sheet leading end passage detection signal obtained by the sensor, bring the upstream driven roller into tight contact with the upstream folding roller, form a first fold by driving the pair of folding rollers in reverse, and form a second fold by moving the folding plate member of the second folding section on a sheet surface so as to push a second predetermined position of the sheet having the first fold to a nip point of the pair of folding rollers, and driving the pair of rollers in reverse.

According to the ninth aspect of the present invention, there is provided the sheet postprocessing apparatus described in the eighth aspect, wherein the first folding section, the binding section, and the second folding section are sequentially arranged in series in the sheet convey direction.

According to the 10th aspect of the present invention, there is provided a folding method for a Z-fold process method using first and second folding sections of a sheet postprocessing apparatus including a pair of folding rollers which are in tight contact with each other to form a nip point and rotate in predetermined opposite directions, a driven roller which is brought into tight contact with one of the pair of folding rollers to be driven/rotated, and a driven roller which is brought into tight contact with the other of the pair of folding rollers to be driven/rotated, comprising the step of forming a first fold using the first folding section, the step of buckling the sheet and making the sheet be caught between the pair of folding rollers at the nip point by rotating the pair of folding rollers in the predetermined directions while the sheet on which the first fold is formed is clamped between the pair of folding rollers and the respective driven rollers and a leading end of a flap portion of the sheet is in contact with a surface of one roller, thereby forming a second fold, the step of bringing back the second fold caught at the nip point and the leading end of the flap portion of the sheet from the nip point to a nip point releasing position by reversing the pair of rollers in directions opposite the predetermined directions, and the step of causing the sheet with the second fold and the leading end of the flap portion of the sheet being in tight contact with each other to pass through the nip point again by rotating the pair of folding rollers in the predetermined directions again.

As is obvious from the above aspects, according to the present invention, the following effects can be obtained.

(1) A space-saving sheet postprocessing apparatus can be realized, which can selectively process a sheet discharged from an image forming apparatus either as a sheet to be subjected to one of four types of folding processes, i.e., a Z-fold process, an internal three-fold process, a center folding process with an image-transferred surface facing outside, and a center folding process with an image-transferred surface facing inside, or a sheet subjected to straight paper discharge, i.e., discharging the sheet without any folding process.

(2) Since folding processes for sheets can be done without using any folding knife, damage to the folds of sheets can be prevented, and the sheets subjected to folding processes can be improved in appearance.

(3) Folds can be stably formed at predetermined positions on sheets.

(4) Multiple folding in a folding process can be prevented. Multiple folding that occurs in forming the second fold in a Z-fold process, in particular, can be prevented.

The above and many other objects, features and advantages of the present invention will become manifest to those skilled in the art upon making reference to the following detailed description and accompanying drawings in which preferred embodiments incorporating the principle of the invention are shown by way of illustrative examples.

DETAILED DESCRIPTION OF THE PREFERRED EMBODIMENTS

Several preferred embodiments of a sheet postprocessing apparatus and folding method according to the present invention will be described below with reference to the accompanying drawings.

Figure 1:
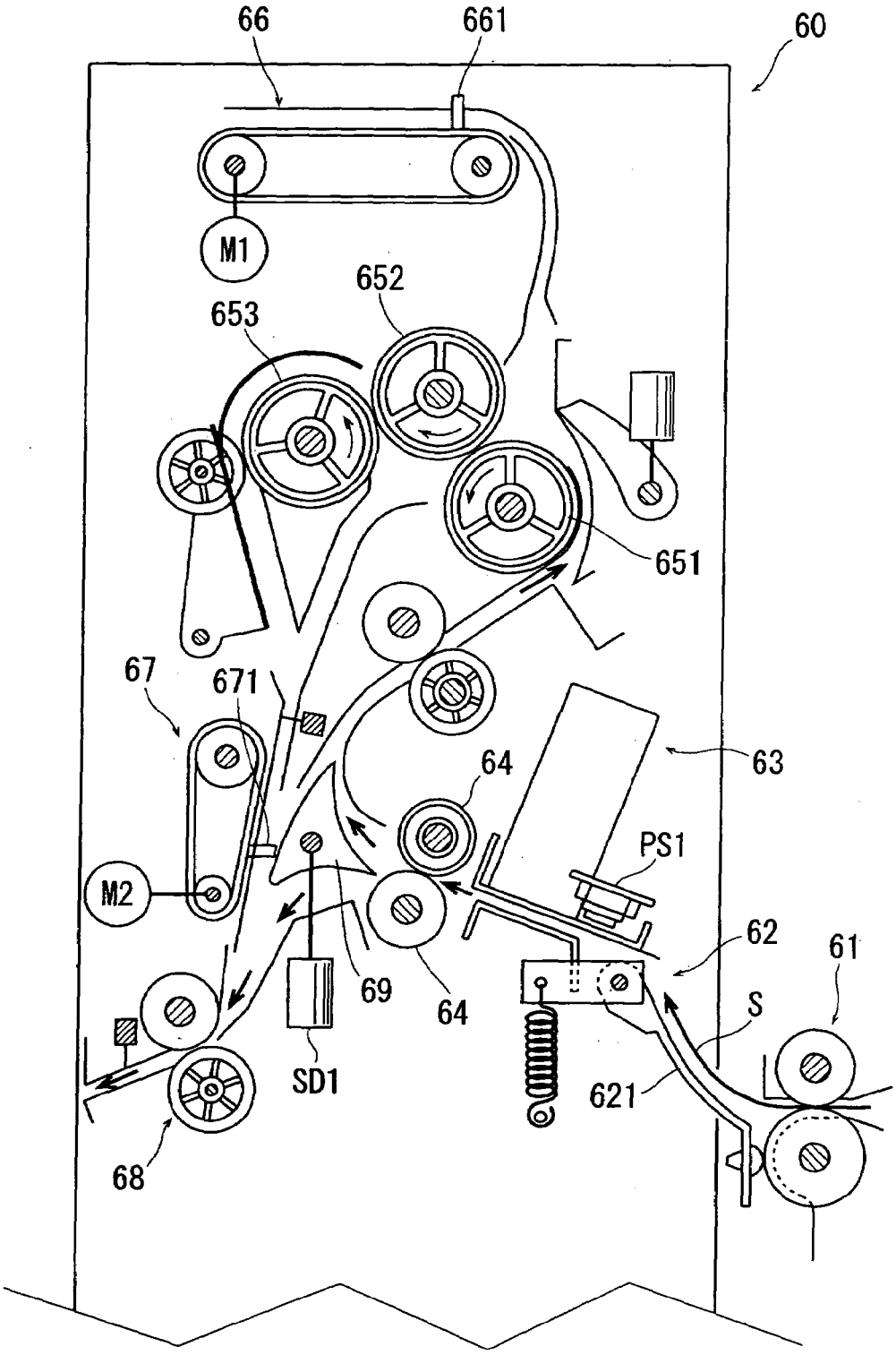
FIG. 1 PRIOR ART
FIG. 1 is a longitudinal sectional view showing the arrangement of the main part of a conventional sheet postprocessing apparatus.
Figure 2A:
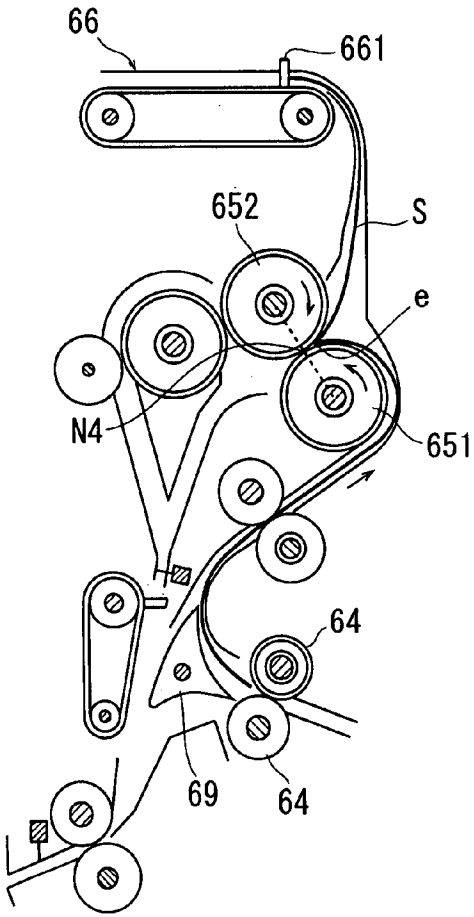
FIG. 2A PRIOR ART
FIGS. 2A to 2C are views showing the steps in a conventional Z-fold process using the sheet postprocessing apparatus.
Figure 2B:
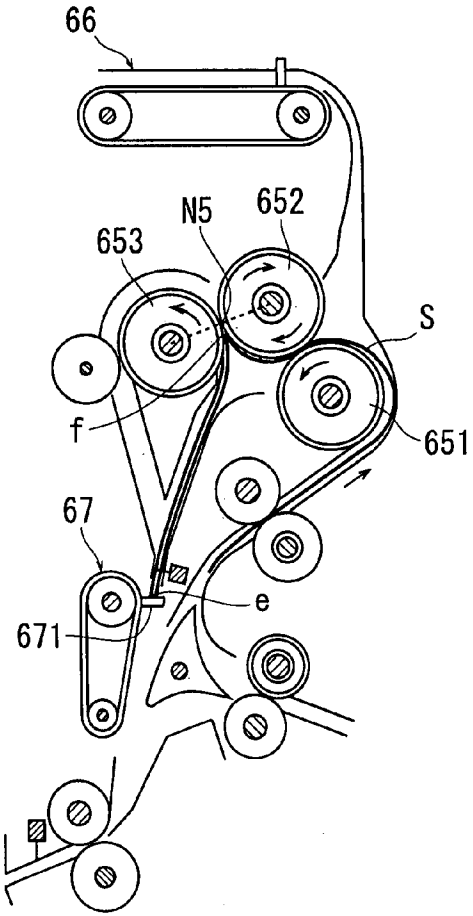
FIG. 2B PRIOR ART
Figure 2C:
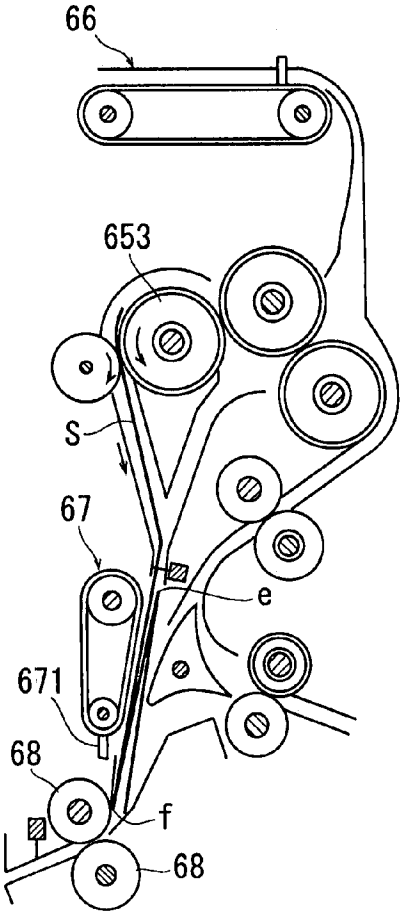
FIG. 2C PRIOR ART
Figure 3A:
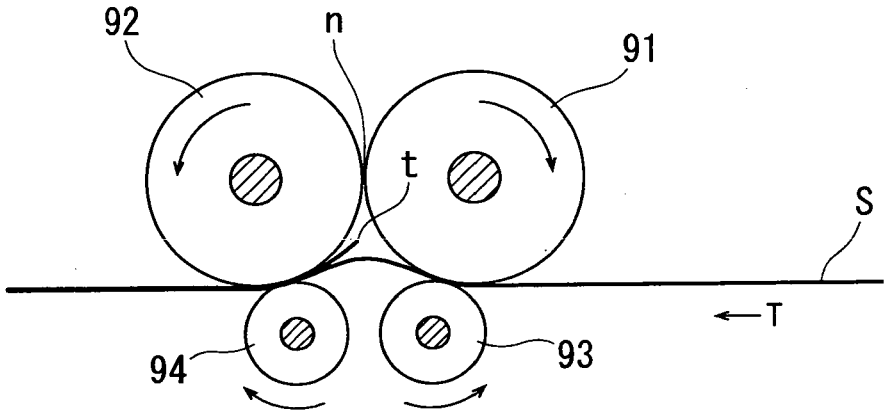
FIG. 3A PRIOR ART
FIGS. 3A and 3B are views showing the steps in the second folding process in a conventional Z-fold process.
Figure 3B:
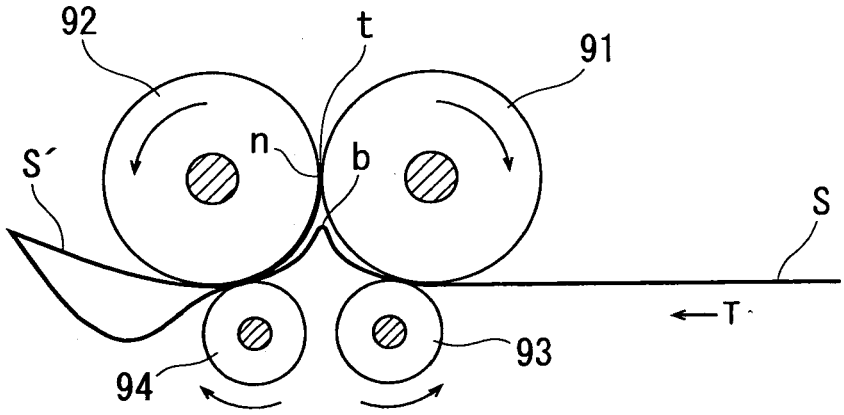
FIG. 3B PRIOR ART
Figure 4:
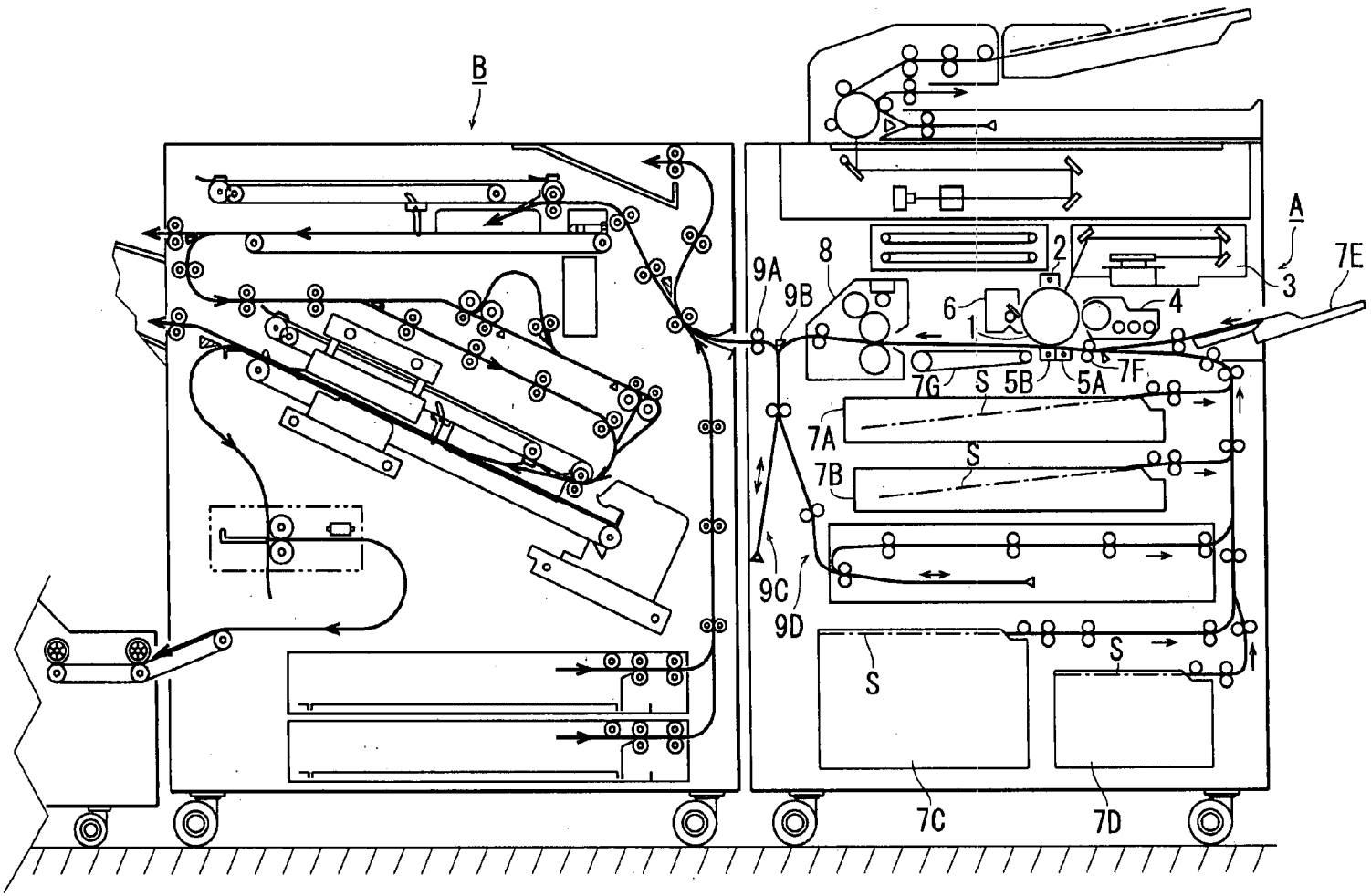
FIG. 4 is a schematic longitudinal sectional view showing the overall arrangement of an image forming system constituted by an image forming apparatus A and a sheet postprocessing apparatus (to be simply referred to as a postprocessing apparatus hereinafter) B.
Figure 5:
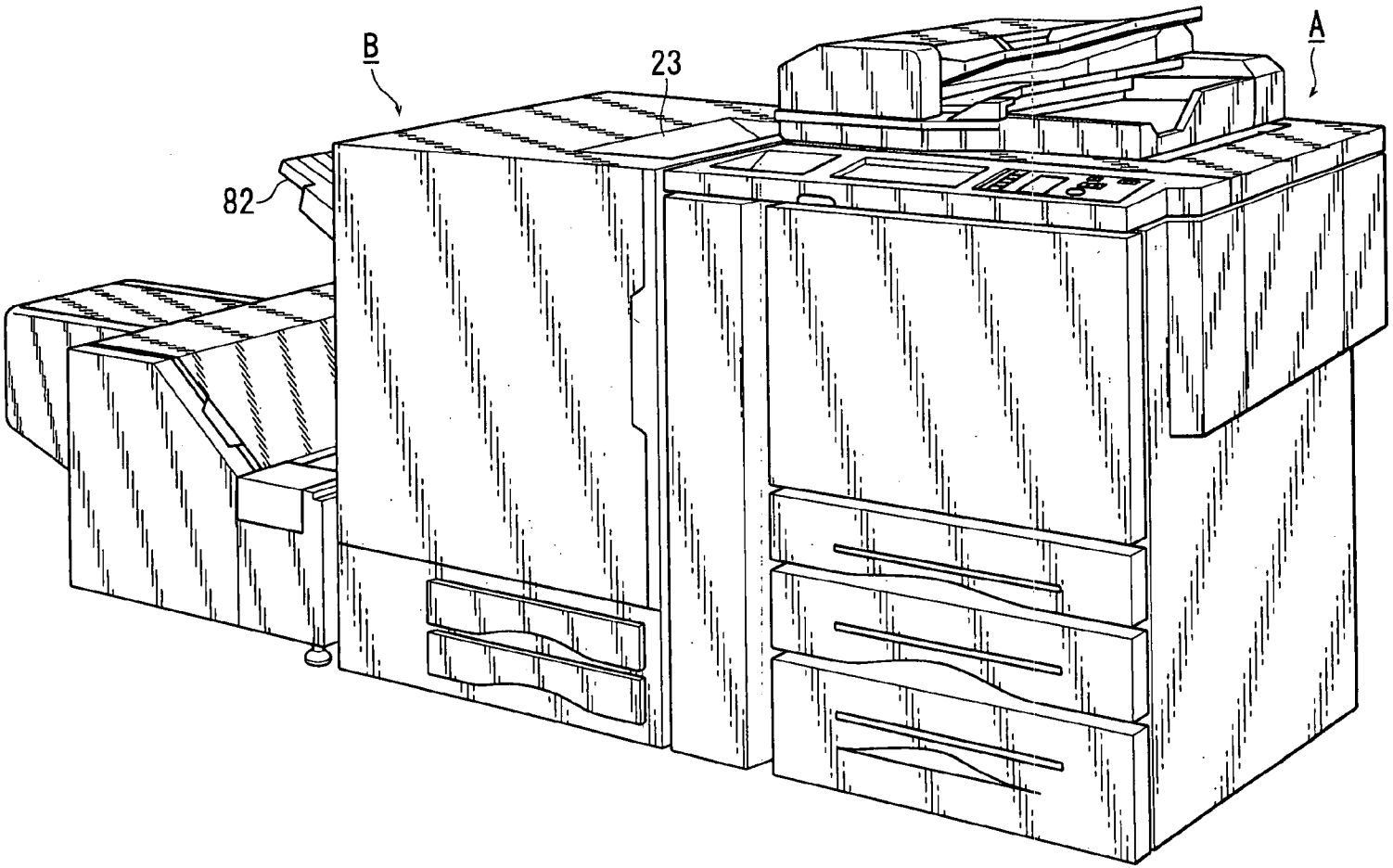
FIG. 5 is a perspective view showing the overall outer appearance of the image forming system.

FIGS. 4 and 5 show the overall arrangement and overall outer appearance of an image forming system including a sheet postprocessing apparatus (to be simply referred to as a postprocessing apparatus hereinafter) B. Reference symbol A denotes an image forming apparatus.

(1) Image Forming Apparatus A:

The image forming apparatus A has an image forming section having a charger 2, image exposure unit (image write section) 3, developing unit 4, transfer unit 5A, discharging/separating unit 5B, and cleaning unit 6 which are arranged around a rotating electrostatic latent image bearing body (to be referred to as an image bearing body hereinafter) 1. The image forming section uniformly charges the surface of the image bearing body 1 using the charger 2, and then forms a latent image by performing exposure/scanning based on the image data read from an original with a laser beam from the image exposure unit 3. The image forming section performs reversal development of the latent image using the developing unit 4 to form a toner image on the surface of the image bearing body 1.

Sheets S are fed from paper feed cassettes 7A and 7B arranged on the middle layer of the image forming apparatus A, large-capacity paper feed trays 7C and 7D arranged on the lower layer of the apparatus, a manual paper feed tray 7E disposed on a side of the apparatus, and the like. The fed sheet S is sent to a transfer position through registration rollers 7F.

At the transfer position, the transfer unit 5A transfers the toner image onto the sheet S. Thereafter, the discharging/separating unit 5B erases charges on the lower surface of the sheet S and separates the sheet from the image bearing body 1. Subsequently, the sheet is conveyed by a paper convey section 7G, and the toner image is heated and fixed by a fixing unit 8. The sheet S that has passed through the fixing unit 8 passes through a paper path on the right side of a convey path switching plate 9B and is delivered into a reverse convey section 9C at a lower position. The sheet is reversed and moved upward to pass through a paper path on the left side of the convey path switching plate 9B. The sheet is then discharged by paper discharge rollers 9A.

When images are to be transferred/formed on the two surfaces of the sheet S, the sheet S on which an image is heated and fixed by the fixing unit 8 is caused to branch from a normal paper discharge path by the convey path switching plate 9B After the sheet is switched back and reversed upside down by a double-sided sheet convey section 9D, the sheet passes through the image forming section again. As a consequence, an image is transferred/formed on the lower surface of the sheet S. The sheet then passes through the fixing unit 8 and discharged outside the apparatus by the paper discharge rollers 9A.

A developing agent remaining on the surface of the image bearing body 1 after image processing is removed by the cleaning unit 6, so the image bearing body prepares for the next image transfer/formation.

The postprocessing apparatus B of the present invention will be described next with reference to FIGS. 6A, 6B, 7A, and 7B.

Figure 6A:
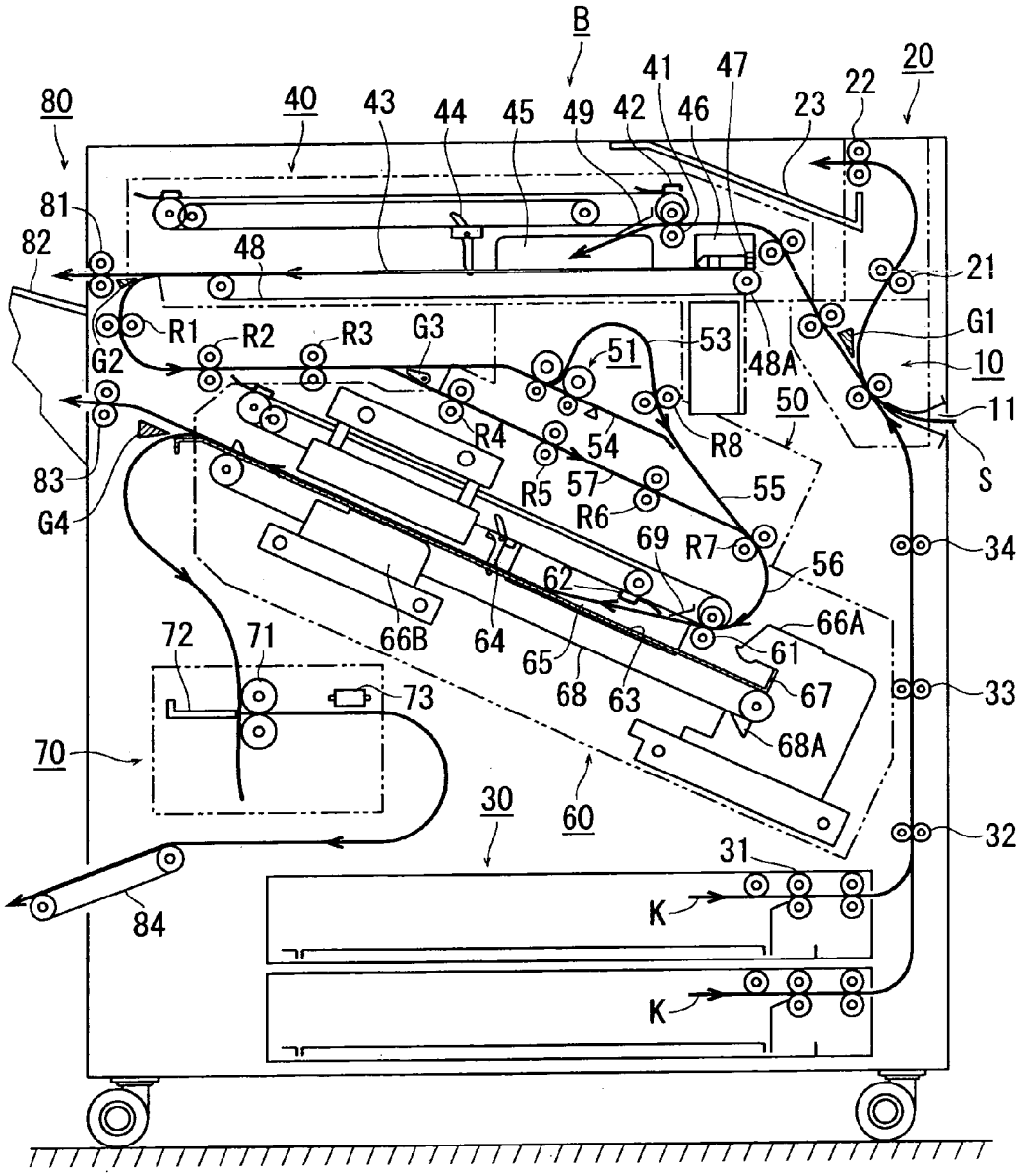
FIGS. 6A and 6B are schematic longitudinal sectional views showing the overall arrangements of sheet postprocessing apparatuses according to the first and second embodiments of the present invention.
Figure 6B:
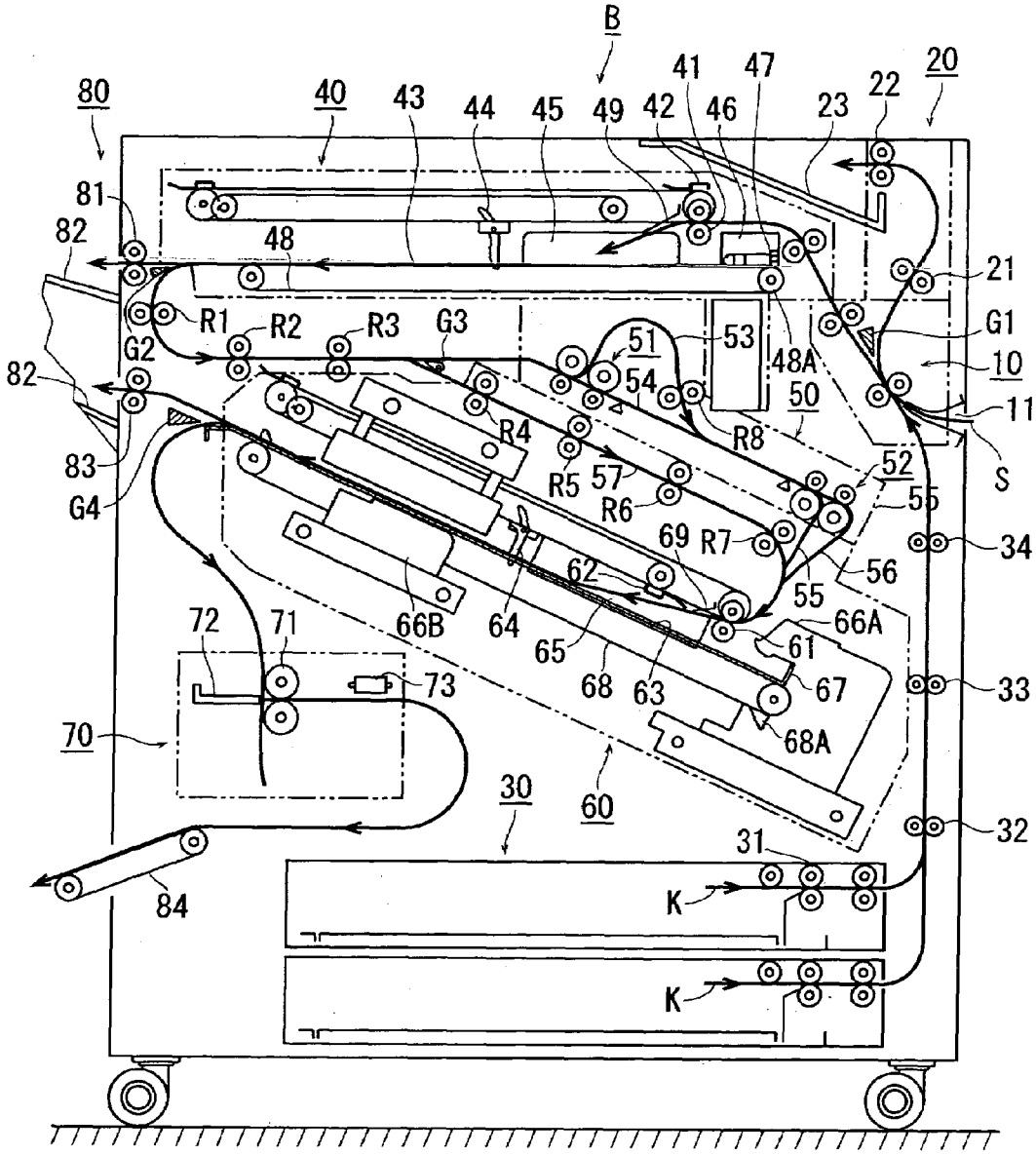

(2) Postprocessing Apparatus B:

FIGS. 6A and 6B respectively show the overall arrangements of the first and second embodiments of the postprocessing apparatus B according to the present invention. Each postprocessing apparatus B is comprised of a receiving section 10, a direct paper discharge section 20, a front cover paper feeding unit 30, a punching section 40, a sheet folding section 50, a binding section 60, a sheet bundle center folding section 70, a paper discharge section 80, convey paths, and a plurality of convey path switching means. Note, however, that in the first embodiment, the sheet folding section 50 serves as the first folding section, and the sheet bundle center folding section 70 serves as the second folding section.

(2-1) Receiving Section 10

An inlet 11 of the receiving section 10 is set at a position and height which match those of the paper discharge rollers 9A of the image forming apparatus A.

The receiving section 10 receives the sheet S having undergone image formation processing from the image forming apparatus A and front cover paper K supplied from the front cover paper feeding unit 30.

The sheet S delivered to the inlet 11 is caused to branch to the direct paper discharge section 20 or punching section 40 by a convey path switching means G1.

(2-2) Direct Paper Discharge Section 20

When this sheet convey operation is set, the convey path switching means G1 shuts the convey path to the punching section 40 and releases the convey path to the direct paper discharge section 20.

Each sheet S that passes through the convey path to the direct paper discharge section 20 is clamped by convey rollers 21 to be moved upward, and is discharged by paper discharge rollers 22. The sheets are sequentially stacked on a fixed paper discharge base 23. A maximum of about 200 sheets S can be stacked on the fixed paper discharge base 23.

(2-3) Front Cover Paper Feeding Unit 30

The front cover paper K stored in the sheet tray of the front cover paper feeding unit 30 is separated and fed by a paper feed means 31. This paper is then clamped by convey rollers 32, 33, and 34 to be delivered into the receiving section 10. Note that insert paper can be loaded in the front cover paper feeding unit 30 to be fed. The recording sheets (transfer sheets) S, front cover paper K, and insert paper will be generically called sheet S.

(2-4) Punching Section 40

The sheet S caused to branch by the convey path switching means G1 of the receiving section 10 is conveyed to the punching section 40 disposed on the uppermost layer of the postprocessing apparatus B. The sheet S passes through inlet rollers 41 and travels while being held by a gripper 42 that moves at the same linear velocity as that of the outer surfaces of the inlet rollers 41.

When the trailing end of the sheet S passes through the clamping position of the inlet rollers 41, the trailing end of the sheet S becomes free and falls onto a sheet mount base 43. Thereafter, when the leading end of the sheet S held by the moving gripper 42 comes into contact with a sheet leading end restricting member 44, the gripper 42 releases the held leading end of the sheet S. The leading end of the sheet S with the released leading end falls freely.

The sheet S placed on the sheet mount base 43 is pressed by the sheet leading end restricting member 44 to come into contact with a sheet abutment portion 47 a punching unit 46 and stop. In the process of alignment in the sheet conveying direction, a sheet width adjusting means 45 positions the sheet S in the widthwise direction. Subsequently, the punching unit 46 forms filing holes h in portions near the leading end of the sheet S.

The punching unit 46 is comprised of a punch that is driven vertically by a driving means, and dice fitted on the end portions of the punch.

The trailing end of the punched sheet S is pressed by a paper discharge pawl 48A fixed to a pivoting paper discharge belt 48 to be moved to the left in FIG. 6A on the sheet mount base 43. The sheet is then clamped by paper discharge rollers 81 and placed on an elevating paper discharge base 82. Alternatively, the sheet S caused to branch by a convey path switching means G2 is subjected to postprocessing such as binding and folding.

The punching section 40 can perform a shift process. That is, the sheet S can be moved in the widthwise direction.

The direction of the sheet S to be subjected to a binding process and folding process is changed to the downward direction by the convey path switching means G2. The sheet is further moved to the right in FIG. 6A by a plurality of convey rollers R1, R2, and R3. A convey path switching means G3 switches the sheet S to one of convey paths to the sheet folding section 50 and binding section 60.

(2-5A) First Embodiment of Sheet Folding Section 50

The sheet folding section 50 of the first embodiment is comprised of a first folding section 51, a convey roller R8, convey paths 53, 54, 55, and 56, and a bypass convey path 57.

The folding section 51 performs the first folding process in an internal three-fold process or a center folding process with an image-formed surface facing outside for the sheet S that has passed through a convey path above the convey path switching means G3 and traveled to the sheet folding section 50.

The first folding section 51 is comprised of folding rollers 511 and 512 which come into tight contact with each other and rotate, a driven roller 513 which is detachably brought into contact with the folding roller 511 to be driven/rotated, and a driven roller 514 which is detachably brought into contact with the folding roller 512 to be driven/rotated.

The sheet S conveyed to the first folding section 51 passes through an opposing position between the folding roller 511 and the driven roller 513 and clamped by the folding roller 511 and the driven roller 513. The leading end portion of the sheet S then enters the convey path 53 and is stopped at a predetermined position. The arrangement and operation of the folding section 51 will be described in detail with reference to FIGS. 9A, 11A to 11F, and 15A to 15C.

The sheet S folded by the folding section 51 passes through the convey path 54 and is discharged while being clamped by the convey rollers R8. The sheet then passes through the convey paths 55 and 56 and travels to the binding section 60.

The sheet S for which no folding process is to be done by the folding section 51 is discharged from the punching section 40 and conveyed by the convey rollers R1, R2, and R3. This sheet is caused to branch by the convey path switching means G3 and passes through the bypass convey 57 constituted by convey rollers R4, R5, and R6. The sheet is then clamped by convey rollers R7 and sent to the binding section 60.

Figure 7A:
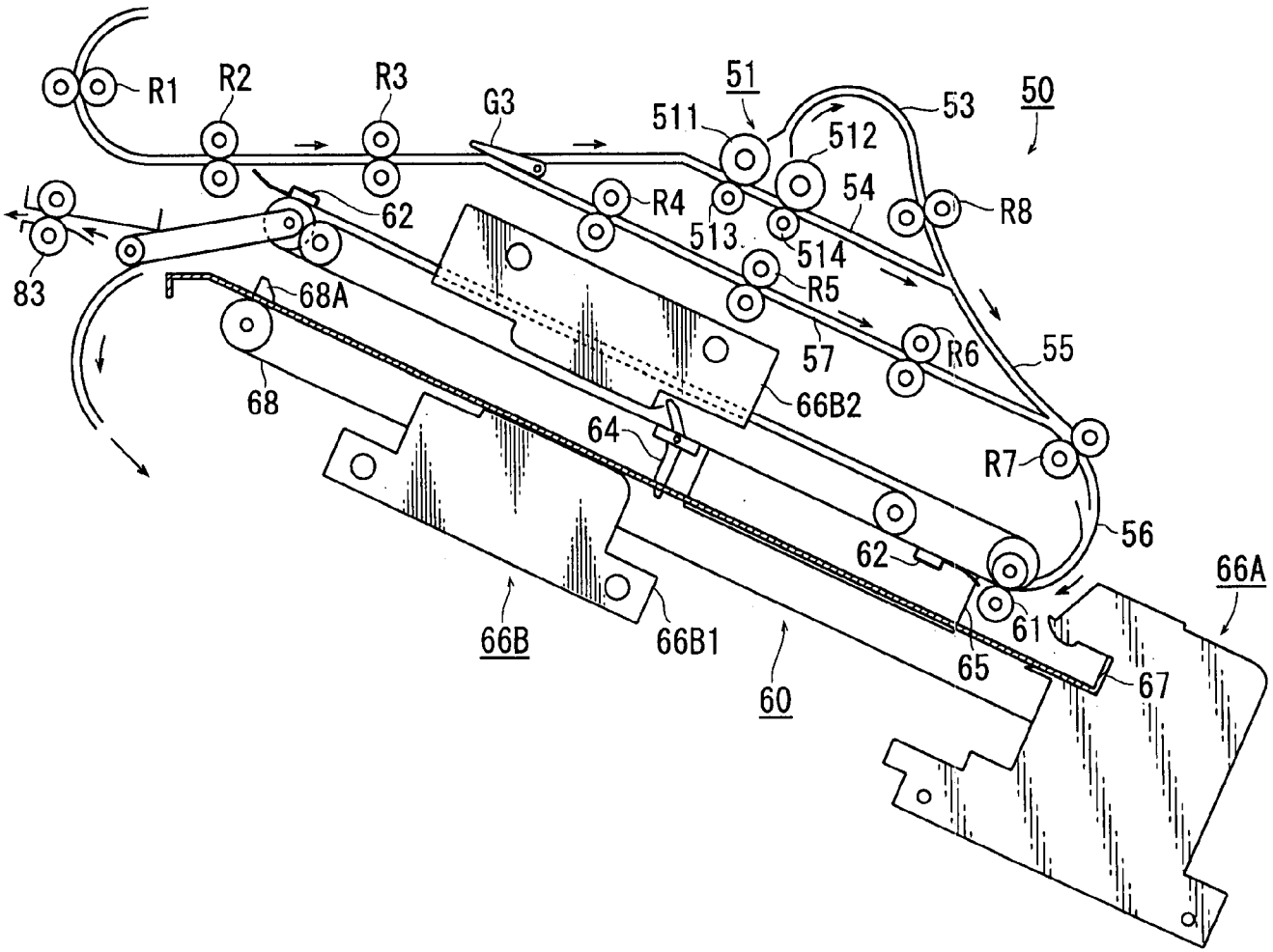
FIGS. 7A and 7B are sectional views showing the main parts of sheet folding sections and binding sections according to the first and second embodiments.

The sheet S that has been sent into the binding section 60 and has undergone a binding process or has not undergone it is conveyed to a sheet mount base 63 in the binding section 60, pressed by a paper discharge pawl 68A fixed to a pivoting paper discharge belt 68 to be moved to the left in FIG. 7A on the sheet mount base 63. The sheet is then clamped by paper discharge rollers 83 and placed on the elevating paper discharge base 82.

(2-5B) Second Embodiment of Sheet Folding Section 50

Figure 7B:
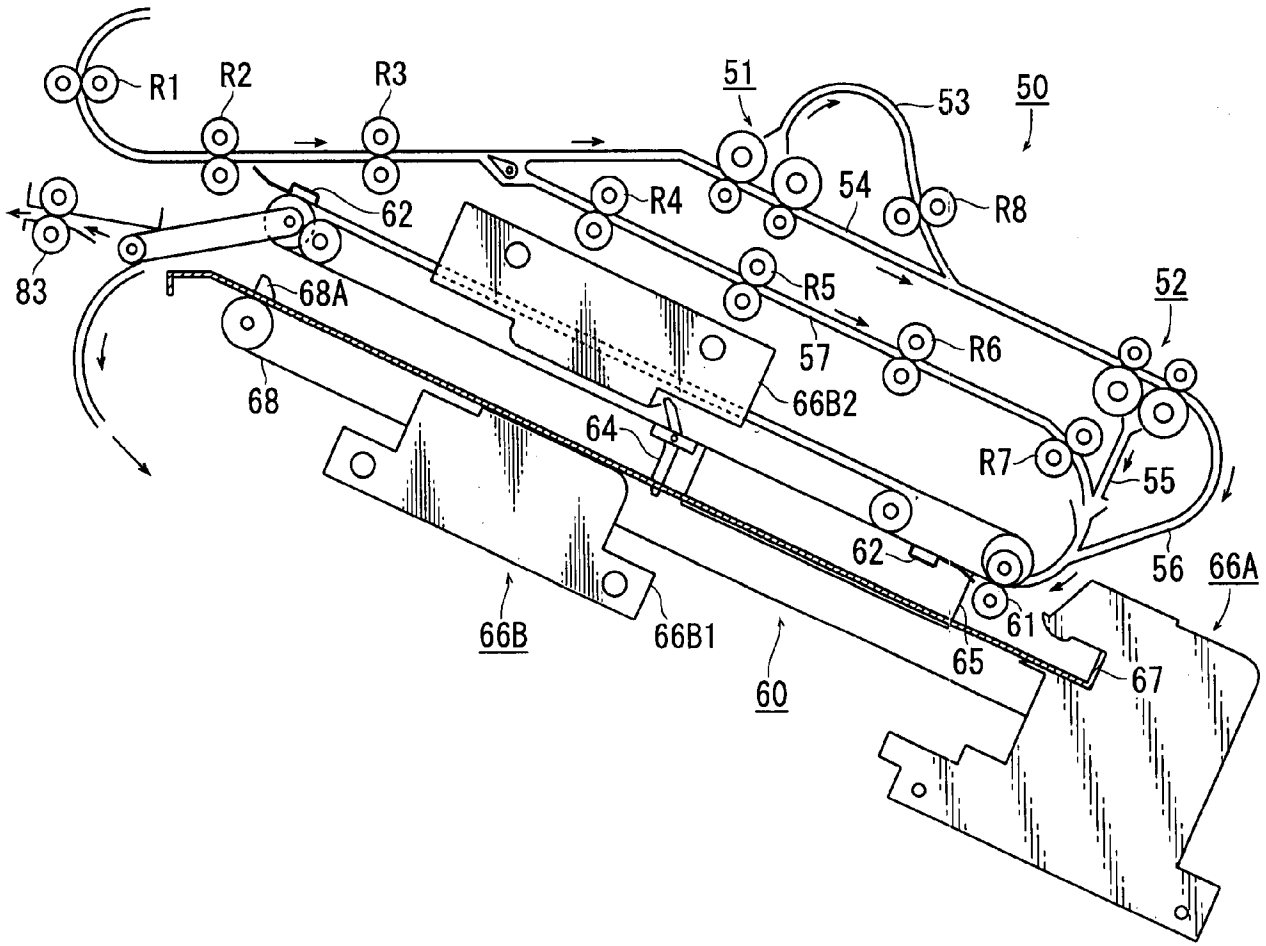

As is obvious from FIG. 7B, a sheet folding section 50 according to the second embodiment is comprised of a first folding section 51, convey rollers R8, a second folding section 52, convey paths 53, 54, 55, and 56, and a bypass convey path 57.

The first folding section 51 performs the first folding process in an internal three-fold process, the first folding process in a Z-fold process, or a center folding process with an image-formed surface facing outside for the sheet S that has passed through a convey path above a convey path switching means G3 shown in FIG. 6B and traveled to the sheet folding section 50. The respective operations will be described later with reference to FIGS. 12A to 12C, 13A to 13C, and 15A to 15C.

The sheet S folded by the first folding section 51 passes through the convey path 53, is discharged while being clamped by the convey rollers R8, and travels to the second folding section 52. The sheet S to be subjected to a center folding process with its image-formed surface facing inside passes through the first folding section 51 without being processed and passes through the convey path 54 to travel to the second folding section 52.

The second folding section 52 executes the second folding process in the internal three-fold process, the second folding process in the Z-fold process, or the center folding process with an image-formed surface facing inside for the sheet S. The resultant sheet is sent to the binding section 60 through the convey path 55. The respective folding operations of the second folding section 52 will be described later with reference to FIGS. 12D to 12F, 13D to 13F, and 14C and 14D.

The sheet S for which a center folding process with an image-formed surface facing outside has been executed by the first folding section 51 is sent to a binding section 60 through the convey path 56 without being processed by the second folding section 52.

The sheet S for which no folding process is to be done by the first folding section 51 and/or the second folding section 52 is directly sent from a punching section 40 to the binding section 60 through the bypass convey path 57.

The sheet S which has been delivered into the binding section 60 and is not subjected to a binding process is conveyed onto a sheet mount base 63 in the binding section 60. The sheet is pressed by a paper discharge pawl 68A fixed to a pivoting paper discharge belt 68 to be moved to the left in FIG. 7B on the sheet mount base 63. The sheet is then clamped by paper discharge rollers 83 and placed on an elevating paper discharge base 82.

(2-6) Binding Section 60

In the binding section 60, sheets S are stacked and aligned and subjected to a side stitching process or saddle stitching process.

<Side Stitching Process>

The sheet S to be subjected to a side stitching process travels on a convey path below the convey path switching means G3, passes through convey rollers R4, R5, R6, and R7 and inlet rollers 61, and travels to the binding section 60. The sheet is then held by a gripper 62 and travels at the same linear velocity as that of the outer surfaces of the inlet rollers 61.

When the trailing end of the sheet S passes through the clamping position of the inlet rollers 61, the trailing end of the sheet S becomes free and falls onto the sheet mount base 63. Thereafter, the leading end of the sheet S held by the moving gripper 62 comes into contact with a sheet leading end restricting member 64. The gripper 62 then releases the held leading end portion of the sheet S. The leading end of the released sheet S falls under its own weight. As a consequence, the sheet quickly moves downward on the sheet mount base 63 on which it is placed obliquely.

The sheet S placed on the sheet mount base 63 is pressed by the sheet leading end restricting member 64 to come into contact with a sheet abutment portion 67 of a side stitcher (side stitching means) 66A and stop. In an alignment process in the sheet convey direction, a sheet width adjusting means 65 positions the sheet S in the widthwise direction.

Every time one of a plurality of succeeding sheets S is sequentially stacked and loaded on the sheet mount base 63, alignment in the sheet convey direction and alignment in the widthwise direction are performed. When a predetermined number of sheets are completely stacked, the side stitcher 66A drives staples SP into portions near the leading end portion of the sheet S to form a sheet bundle Sa.

The trailing end portion of the sheet bundle Sa subjected to the side stitching process is pressed by the paper discharge pawl 68A fixed to the pivoting paper discharge belt 68 to move to the left in FIG. 7B on the sheet mount base 63. The sheet bundle is then clamped by the paper discharge rollers 83 and placed on the elevating paper discharge base 82.

<Saddle Stitching Process>

A saddle stitcher (saddle stitching means) 66B has a two-piece structure constituted by a staple driving mechanism 66B1 on the lower side and a staple receiving mechanism 66B2 on the upper side. A paper path through which the sheet S can pass is formed between these mechanisms.

When a saddle stitching process is designated, the sheet leading end restricting member 64 moves to a predetermined position set downstream in a sheet convey direction corresponding to a paper size and stops at the position.

The sheet S to be subject to a saddle stitching process is held by the gripper 62 which moves at the same linear velocity as that of the outer surfaces of the inlet rollers 61 and travels.

When the trailing end portion of the sheet S passes through the clamping position of the inlet rollers 61, the trailing end portion of the sheet S falls onto the sheet mount base 63. Thereafter, the leading end portion of the sheet S held by the moving gripper 62 comes into contact with the sheet leading end restricting member 64. As a consequence, the gripper 62 releases the leading end portion of the sheet S. The leading end portion of the released sheet S falls under its own weight. The sheet thus quickly moves downward onto the sheet mount base 63 on which the sheet is placed obliquely.

The sheet S obliquely placed on the sheet mount base 63 slides downward on the sheet mount base 63 to come into contact with the sheet abutment portion 67 and stop. At the stop position of the sheet S, the sheet width adjusting means 65 positions the sheet S in the widthwise direction.

Every time one of a plurality of succeeding sheets S is sequentially stacked and loaded on the sheet mount base 63, alignment in the sheet convey direction and alignment in the widthwise direction are performed. When a predetermined number of sheets are completely stacked, the saddle stitcher 66B drives staples SP into the middle portions of the sheets S to form a sheet bundle Sa.

The trailing end portion of the saddle-stitched sheet bundle Sa is pressed by the paper discharge pawl 68A fixed to the pivoting paper discharge belt 68 to move to the left in FIG. 7B on the sheet mount base 63. The sheet bundle Sa then travels on a convey path below a convey path switching means G4 and is conveyed to a sheet bundle center folding section 70.

(2-7) Sheet Bundle Center Folding Section 70

In the first embodiment having no second folding section 52 in the sheet folding section 50, the sheet bundle center folding section 70 serves as the second folding section.

In the sheet bundle center folding section 70, the saddle-stitched sheet bundle Sa is center-folded by a first folding roller pair 71 and center folding plate member (folding knife) 72. The sheet bundle center folding section 70 will be described in detail later with reference to FIG. 10.

A fold a of the center-folded sheet bundle Sa is strengthened by a second folding roller (strengthening roller). The center-folded sheet bundle Sa is discharged outside the apparatus by a paper discharge belt 84.

Figure 8A:
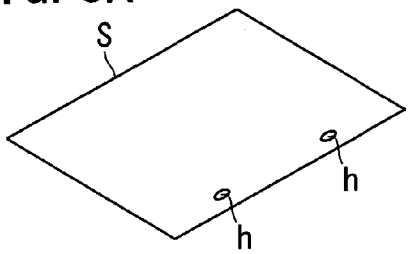
FIGS. 8A to 8H are perspective views respectively showing a sheet subjected to a punching process, a sheet subjected to a center folding process, a sheet subjected to a Z-fold process, a sheet subjected to an internal three-fold process, a sheet bundle subjected to a side stitching process, a sheet bundle subjected to a saddle stitching process, and a sheet bundle subjected to a saddle stitching process and center folding process.
Figure 8B:
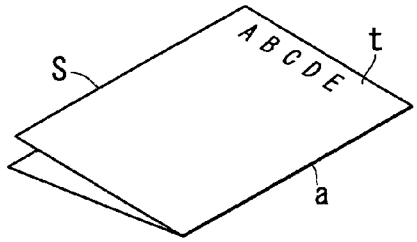
Figure 8C:
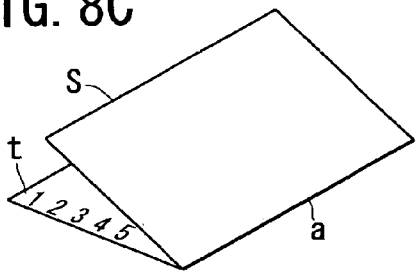
Figure 8D:
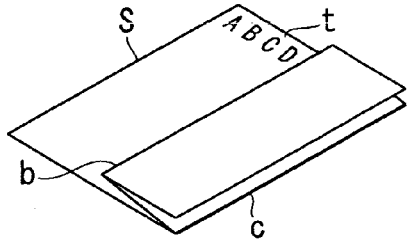
Figure 8E:
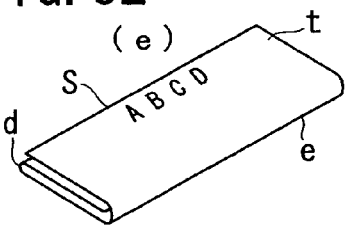
Figure 8F:
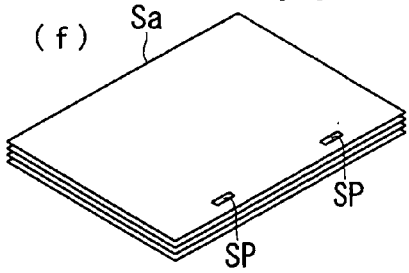
Figure 8G:
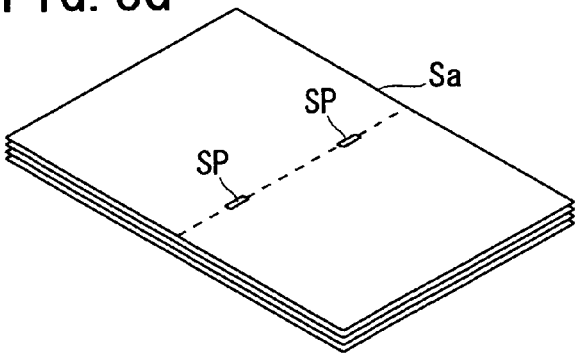
Figure 8H:
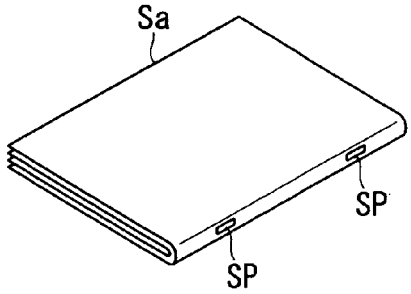

FIGS. 8A to 8H are perspective views showing the respective sheets subjected to the above processes. More specifically, FIG. 8A shows the sheet S subjected to a punching process. FIG. 8B shows the sheet S subjected to a center folding process with an image-formed surface facing outside. FIG. 8C shows the sheet S subjected to a center folding process with an image-formed surface facing inside. FIG. 8D shows the sheet S subjected to a Z-fold process suitable for file loading or the like. FIG. 8E shows the sheet S subjected to an internal three-fold process. FIG. 8F shows the side-stitched sheet bundle Sa. FIG. 8G shows the saddle-stitched sheet bundle Sa. FIG. 8H shows the saddle-stitched, center-folded sheet bundle Sa.

Referring to FIGS. 8A to 8H, reference symbol a denotes the fold of the sheet S subjected to the center folding process; b, the first fold of the sheet S subjected to Z-fold process; c, the second fold; d, the first fold of the sheet S subjected to the internal three-fold process; e, the second fold; h, holes formed by a punching unit 46; and t, an image-transferred surface.

The sheet folding section 50 and folding processes in the present invention will be described in detail next with reference to FIGS. 9A to 20C.

Figure 9A:
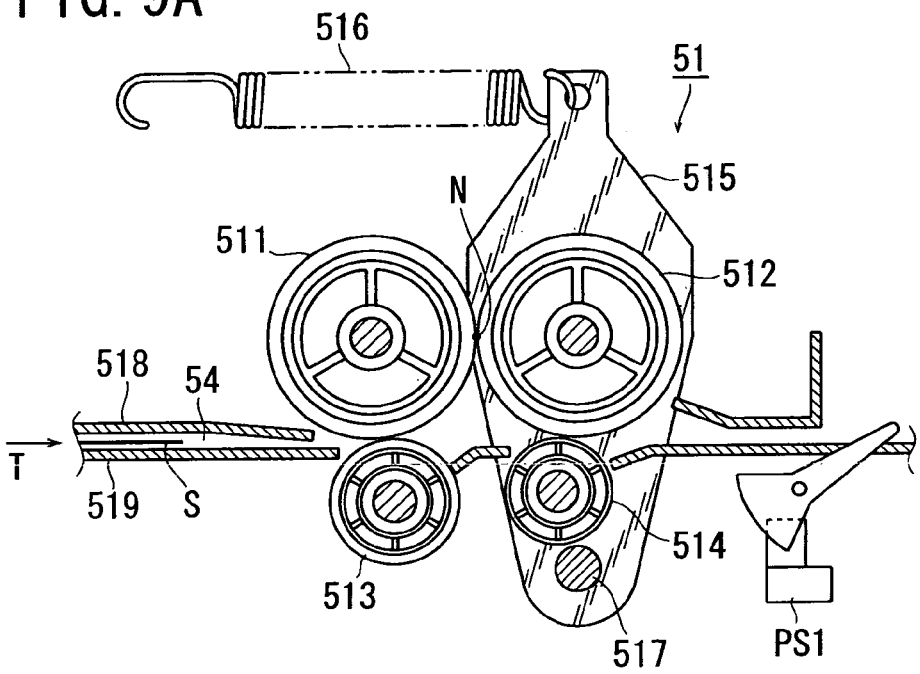
FIG. 9A is a longitudinal sectional view showing the first folding section in a sheet folding section in the first embodiment.

FIG. 9A is a longitudinal sectional view of the first folding section in the first embodiment. The first folding section 51 is comprised of the pair of folding rollers 511 and 512, the pair of driven rollers 513 and 514 smaller in diameter than the folding rollers, a swingable support plate 515 which supports the folding roller 52, a spring 516 for biasing the support plate 515, and the like.

The folding roller 511 fixed on the upstream side in the sheet convey direction (indicted by the arrow T in FIG. 9A) is connected to a drive source (not shown) to be driven/rotated. A gear (not shown) fixed on the shaft of the folding roller 511 meshes with a gear (not shown) fixed on the shaft of the folding roller 512 to drive/rotate the folding roller 512 on the downstream side.

The driven roller 513 is detachably in tight contact with the folding roller 511. The driven roller 514 is detachably in tight contact with the folding roller 512.

The support plate 515 which rotatably supports the folding roller 512 is so supported as to be swingable about a support shaft 517. The support plate 515 is biased toward the folding roller 511 by the spring 516 to bring the folding roller 512 into tight contact with the folding roller 511.

The convey path 54 formed between upper and lower guide plates 518 and 519 allows the sheet S to pass therethrough. A sensor PS1 for detecting the passage of the leading end portion of the sheet S is disposed at a predetermined position on the convey path 54.

Figure 9C:
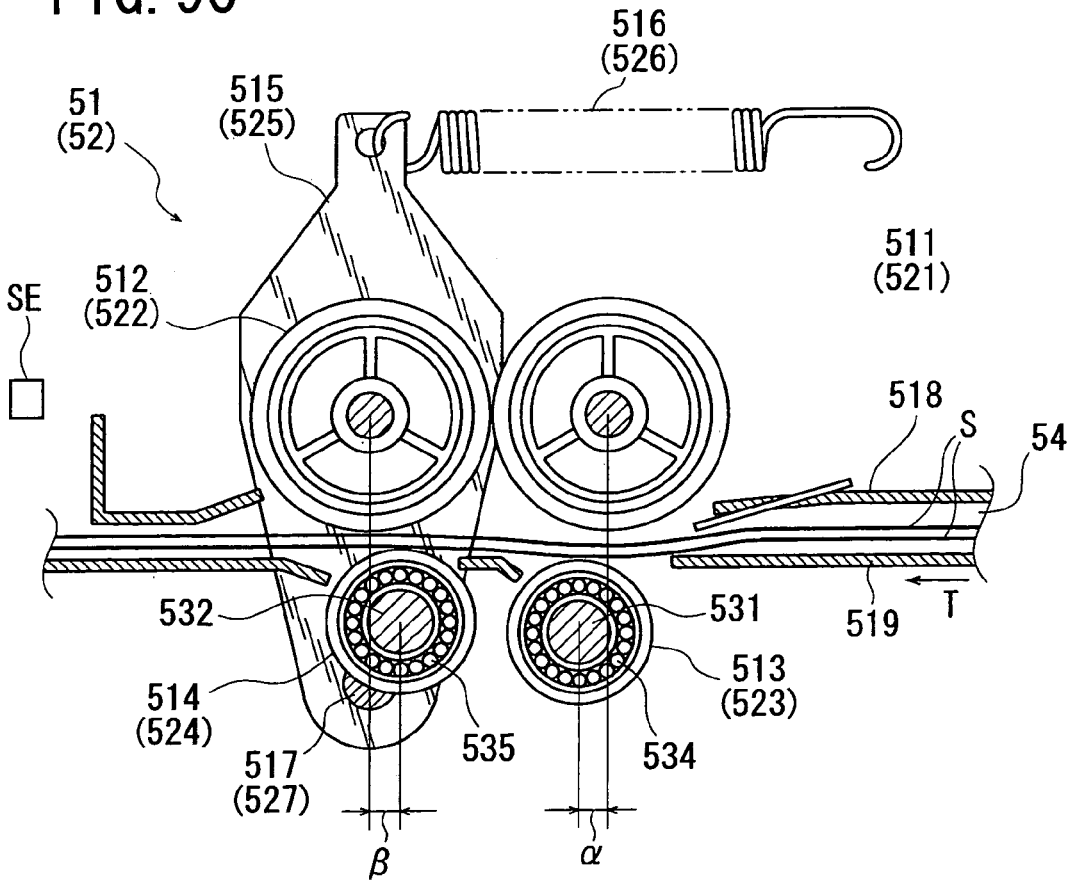
FIG. 9C is a longitudinal sectional view showing a modification of the first folding section.
Figure 9B:
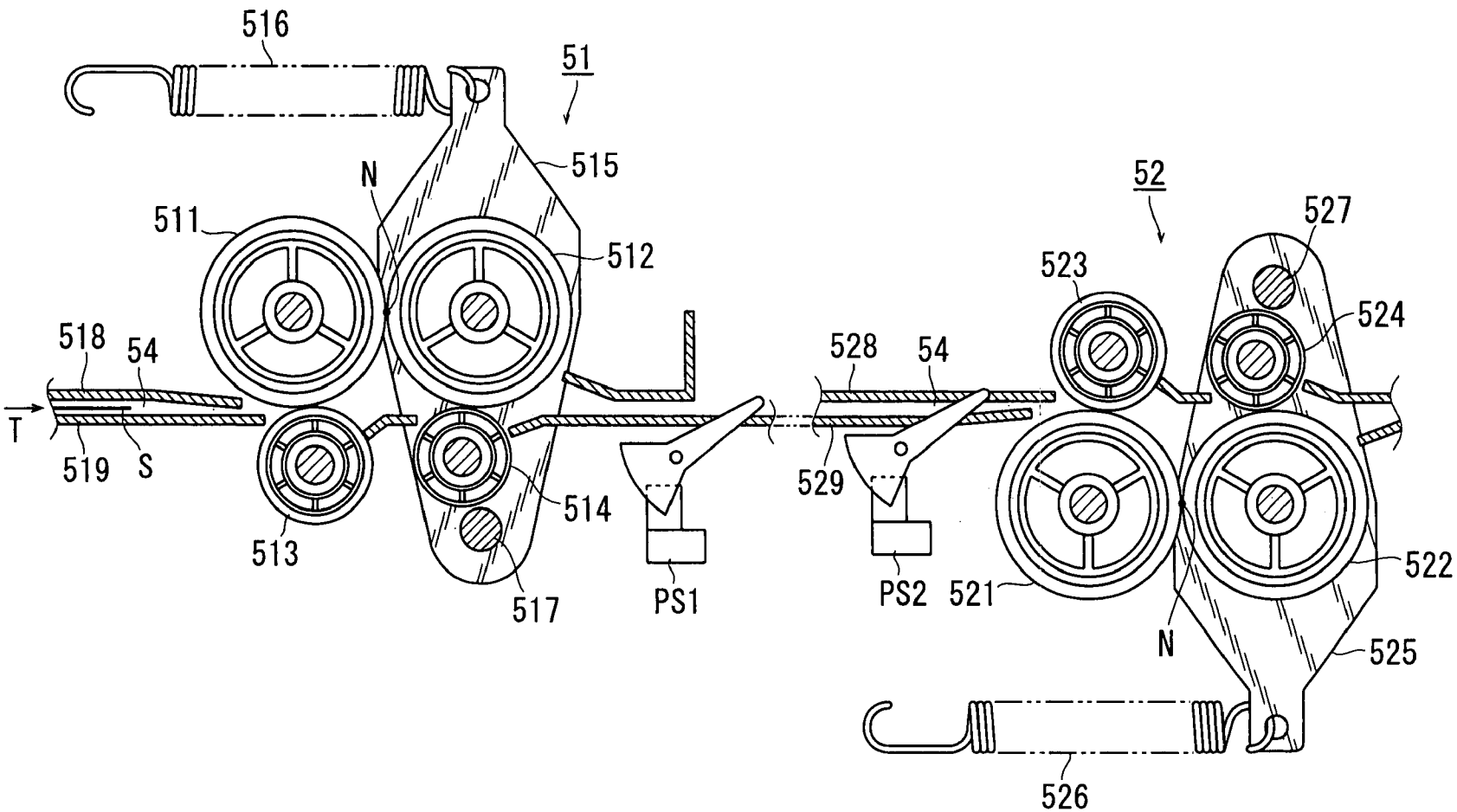
FIG. 9B is a longitudinal sectional view showing the first and second folding sections in a sheet folding section in the second embodiment.

FIG. 9B is a longitudinal sectional view showing the first and second folding sections 51 and 52 in the second embodiment.

The first folding section 51 in the second embodiment has the same arrangement as that of the first folding section 51 in the first embodiment, and hence a description thereof will be omitted.

The second folding section 52 in the second embodiment has an arrangement in which constituent members of the first folding section 51 are vertically reversed in position. The second folding section 52 is comprised of folding rollers 521 and 522, driven rollers 523 an 524 smaller in diameter than the folding rollers, a support plate 525, a spring 526, a support shaft 527, guide plates 528 and 529, a sensor PS2, and the like. The pair of folding rollers 521 and 522 are arranged below the convey path 54, and the pair of driven rollers 523 an 524 are arranged above the convey path 54.

FIG. 9C shows another example of the arrangement of the first folding section 51. As is obvious from FIG. 9C, ball bearings 534 and 535 which are rolling bearings respectively are mounted between driven rollers 513 and 514 and shafts 531 and 532. The center points of the driven rollers 513 and 514 are located inside with respect to the center points of folding rollers 511 and 512 in a sheet convey direction T. More specifically, the center point of the driven roller 513 is located downstream in the sheet convey direction with respect to the center point of the folding roller 511 by 0. The center point of the driven roller 514 is located upstream in the sheet convey direction with respect to the center point of the folding roller 512 by 0. Note that this arrangement can also apply to the second folding section 52 in the second embodiment.

Figure 10:
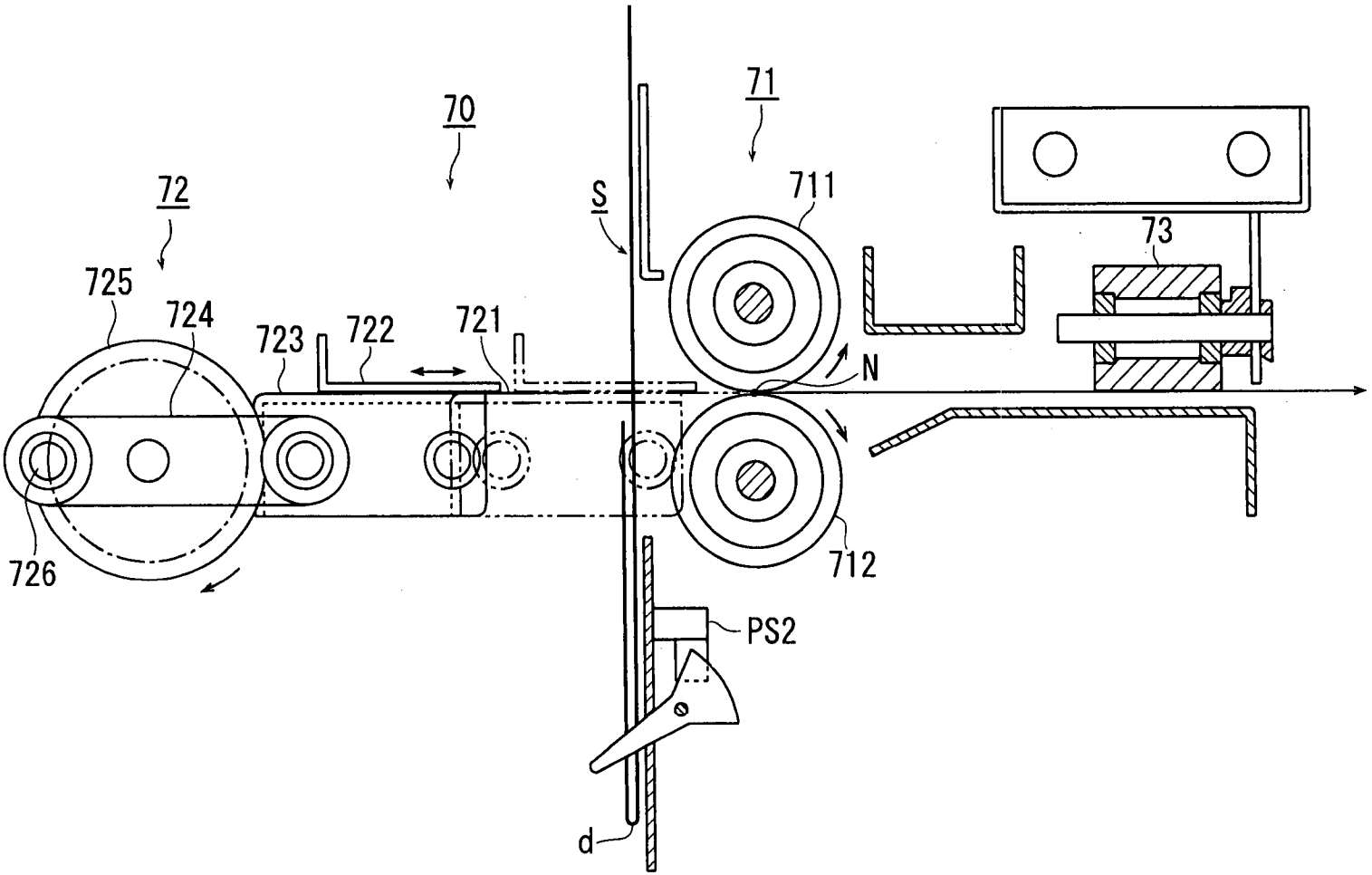
FIG. 10 is a longitudinal sectional view showing the second folding section in the first embodiment or a sheet bundle center folding section in the second embodiment.

The detailed arrangement of the sheet bundle center folding section 70 will be described with reference to FIG. 10.

The sheet bundle center folding section 70 is comprised of the folding roller pair 71, sheet pushing means 72, strengthening folding roller 73, the sensor PS2 for detecting the leading end of a sheet, and the like.

The first folding roller pair 71 is constituted by a pair of folding rollers 711 and 712 which are spring-biased to come into tight contact with each other and are driven/rotated.

The sheet pushing means 72 is constituted by a folding plate member (folding knife) 721, holding member 722, moving member 723, crank 724, and rotating disc 725. The folding plate member 721 is made of a thin stainless steel plate, which is clamped by the holding member 722 and the moving member 723 which moves rectilinearly and reciprocates rectilinearly toward a nip point N between the folding rollers 711 and 712. The moving member 723 is reciprocated rectilinearly by the crank 724, which is engaged with an eccentric pin 726 extending vertically at an eccentric position of the rotating disc 725 driven/rotated by a motor serving as a drive source (not shown), and a rectilinear motion guide member (not shown).

The strengthening folding roller 73 is disposed downstream in the convey direction with respect to the nip point N between the folding rollers 711 and 712. The strengthening folding roller 73 is moved in the widthwise direction of a sheet by a drive means (not shown) to strengthen the fold of the sheet S or sheet bundle Sa at rest.

As described above, in the first embodiment having no second folding section 52 in the sheet folding section 50, the sheet bundle center folding section 70 serves as the second folding section in an internal three-fold process. This operation will be described later with reference to FIGS. 11D to 11F.

The operation steps in various folding processes in the postprocessing apparatus of the present invention will be described below with reference to FIGS. 11A to 11F, 12A to 12F, 13A to 13F, 14A to 14D, and 15A to 15E.

(A) Internal Three-Fold Process in First Embodiment:

The operation steps in an internal three-fold process in the first embodiment will be described first with reference to FIGS. 11A to 11F.

In an internal threefold process for the sheet S, the sheet folding section 50 performs the first folding process in an internal three-fold process, and the sheet bundle center folding section 70 serving as the second folding section performs the second folding process in the internal three-fold process.

Figure 11A:
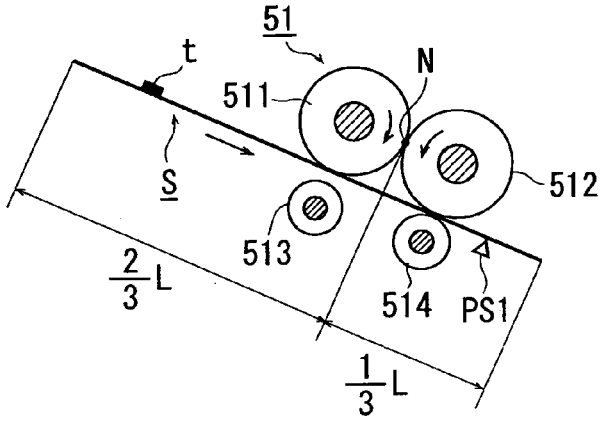
FIGS. 11A to 11F are schematic views showing the steps in an internal three-fold process using the sheet folding section constituted by the first and second folding sections according to the first embodiment of the present invention.

As shown in FIG. 11A, the sheet S discharged from the image forming apparatus A with the image-transferred surface t facing down passes through the punching section 40 in the postprocessing apparatus B and is guided into the first folding section 51 of the sheet folding section 50 with the image-transferred surface t facing up.

The leading end portion of the sheet S conveyed by the first folding section 51 passes between the rotating folding roller 511 and the driven roller 513 separated therefrom. This sheet is then clamped by the rotating folding roller 512 and the driven roller 514 in tight contact therewith and conveyed in the sheet convey direction. When a predetermined period of time elapses after the passage of the leading end of the sheet is detected by the sensor PS1, the rotation of the folding rollers 511 and 512 is stopped by a control means (not shown) to stop the sheet S at a predetermined position. At this sheet stop position, the leading end portion of the sheet S is located downstream in the sheet convey direction with respect to the common tangent at the nip point N between the folding rollers 511 and 512 and has moved forward by a distance corresponding to ⅓ a total length L of the sheet.

Figure 11B:
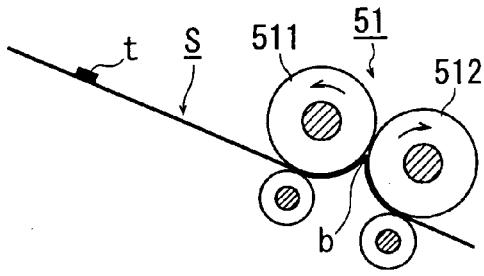

As shown in FIG. 11B, the driven roller 513 is brought into tight contact with the folding roller 511, and the folding rollers 511 and 512 are driven in reverse. As a consequence, a portion of the sheet S which is located on the leading end side in the longitudinal direction and at the ⅓ position is pushed into the nip point N between the folding rollers 511 and 512 and pressurized to form the first fold b in an internal three-fold process.

Figure 11C:
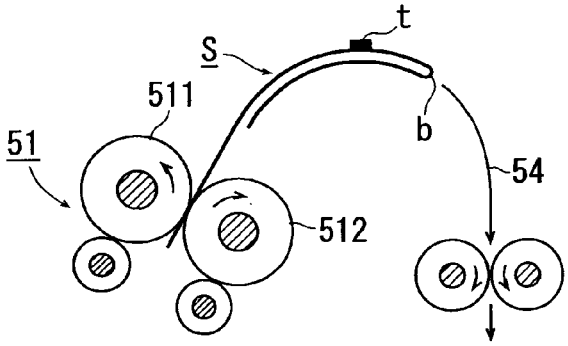

As shown in FIG. 11C, the sheet S on which the first fold b in the internal three-fold process is formed passes through the convey path 53 while being clamped by the rotating folding rollers 511 and 512 and convey rollers R8, and travels to the binding section 60 with the first fold b taking the lead.

Figure 11D:
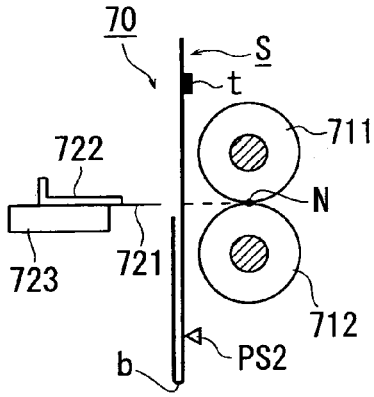

As shown in FIG. 11D, the first fold b of the sheet S conveyed to the second folding section 70 passes through a convey path on a side of the rotating folding rollers 711 and 712. When a predetermined period of time elapses after the passage of the leading end of the sheet is detected by the sensor PS2, the sheet S is stopped at a predetermined position by driving operation controlled by a control means (not shown). This sheet stop position is the position where a middle portion of the sheet S folded by the sheet folding section 50 in the longitudinal direction crosses the common tangent to the folding rollers 711 and 712.

Figure 11E:
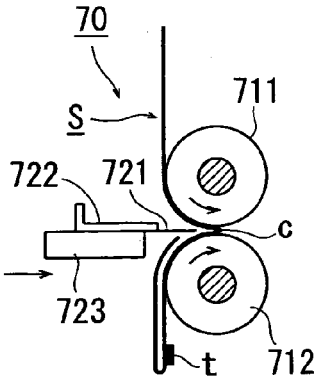

As shown in FIG. 11E, when a motor (not shown) is started, the moving member 723 and the folding plate member (folding knife) 721 held on the holding member 722 move forward. The sheet S folded by the sheet folding section 50 is pushed, at the middle portion in the longitudinal direction, by the leading end portion of the folding plate member 721, and fed to the nip point N of the folding rollers 711 and 712 at rest, thereby forming the second fold c on the sheet S. At this time, as the folding plate member 721 pushes the sheet S, the folding rollers 711 and 712 come into slidable contact with the sheet S and is driven/rotated in only the sheet convey direction.

Figure 11F:
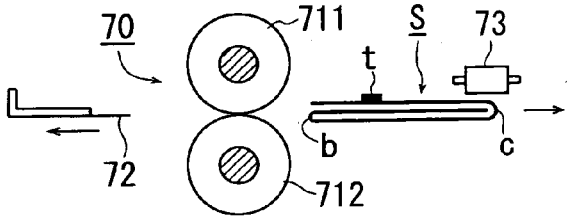

After the leading end portion of the folding plate member 721 has moved to the maximum push position slightly passing the nip point N of the folding rollers 711 and 712, returning operation is started, as shown in FIG. 11F. After the second fold c of the sheet S passes through the nip point N of the folding rollers 711 and 712, the drive source starts driving/rotating th-e folding rollers 711 and 712. The strengthening folding roller 73 is moved in the widthwise direction of the sheet by a driving means (not shown) to strengthen the second fold c of the sheet S at rest.

(B) Internal Three-Fold Process in Second Embodiment:

The operation steps in an internal three-fold process in the second embodiment will be described next with reference to FIGS. 12A to 12F.

In an internal three-fold process for the sheet S, the first folding section 51 performs the first folding process in the internal three-fold process, and the second folding section 52 performs the second folding process in the internal three-fold process.

Figure 12A:
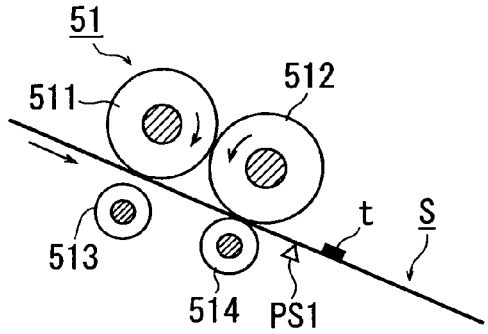
FIGS. 12A to 12F are schematic views showing the steps in an internal three-fold process using the sheet folding section constituted by the first and second folding sections according to the second embodiment of the present invention.

As shown in FIG. 12A, the sheet S that is discharged while the image-transferred surface t formed by the image forming apparatus A faces down passes through the punching section 40 of the postprocessing apparatus B, and is guided to the sheet folding section 50 with the image-transferred surface t facing up.

The leading end portion of the sheet S conveyed to the first folding section 51 passes between the rotating folding roller 511 and the driven roller 513 separated therefrom, and is conveyed in the sheet convey direction while being clamped between the rotating folding roller 512 and the driven roller 514 in tight contact with the roller 512. When a predetermined period of time elapses after the passage of the leading end of the sheet is detected by the sensor PS1, the rotation of the folding rollers 511 and 512 is stopped by a control means (not shown), and the sheet S is stopped at a predetermined position. This sheet stop position is the position where the leading end portion of the sheet S is located downstream of the common tangent at the nip point N of the folding rollers 511 and 512 in the sheet convey direction and has moved forward by a distance corresponding to ⅔ the total length of the sheet.

Figure 12B:
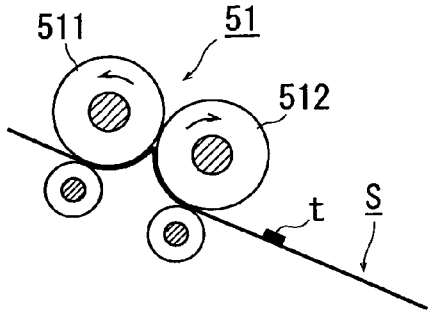

As shown in FIG. 12B, when the driven roller 513 is brought into tight contact with the folding roller 511, and the folding rollers 511 and 512 are driven in reverse, a portion of the sheet S which is located on the trailing end side in the longitudinal direction and corresponds to the ⅔ position is pushed to the nip point N of the folding rollers 511 and 512 and pressurized to form the first fold d in the internal three-fold process.

Figure 12C:
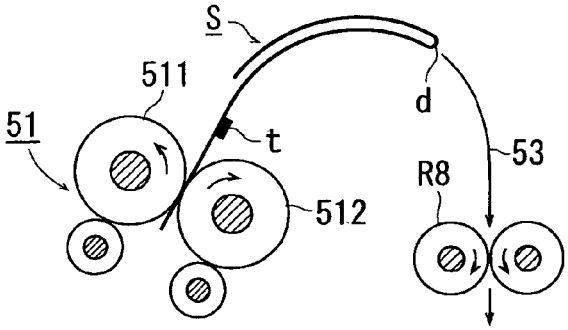

As shown in FIG. 12C, the sheet S on which the first fold d in the internal three-fold process is formed passes through the convey path 53 while being clamped by the rotating folding rollers 511 and 512 and convey rollers R8, and moves to the second folding section 52 with the first fold d taking the lead.

Figure 12D:
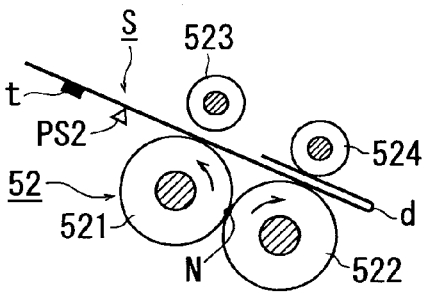

As shown in FIG. 12D, the first fold d of the sheet S conveyed to the second folding section 52 passes between the rotating folding roller 521 and the verification unit 523 separated therefrom, and passes through the clamping position between the rotating folding roller 522 and the driven roller 524 in tight contact therewith. When a predetermined period of time elapses after the passage of the leading end of the sheet is detected by the sensor PS2, the rotation of the folding rollers 521 and 522 is stopped by the control means (not shown), and the sheet S is stopped at a predetermined position.

Figure 12E:
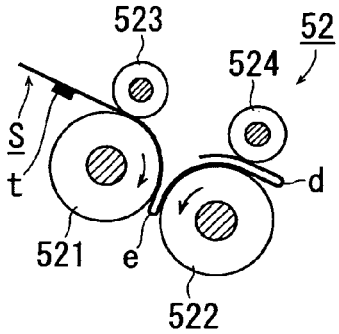

As shown in FIG. 12E, when the driven roller 523 is brought into tight contact with the folding roller 521, and the folding rollers 521 and 522 are driven in reverse, a middle portion between the first fold d and the trailing end portion of the sheet S is pushed to the nip point N of the folding rollers 521 and 522 to form the second fold e in the internal three-fold process.

Figure 12F:
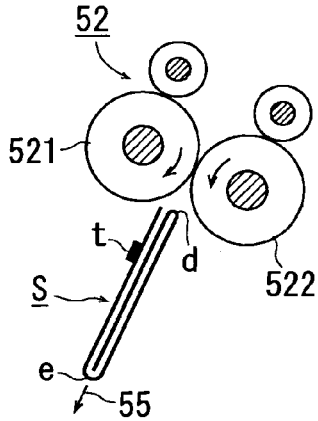

As shown in FIG. 12F, the sheet S that has undergone the internal three-fold process with the second fold e being formed is discharged while being clamped between the rotating folding rollers 521 and 522 with the second fold e taking the lead, passes through the convey path 56, and is moved to the binding section 60.

(C) Z-Fold Process in Second Embodiment:

The operation steps in a Z-fold process in the second embodiment will be described next with reference to FIGS. 13A top 13F.

In a Z-fold process for the sheet S, the first folding section 51 performs the first folding process in the Z-fold process, and the second folding section 52 performs the second folding process in the Z-fold process.

Figure 13A:
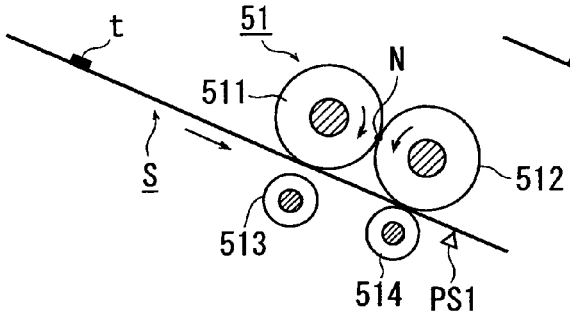
FIGS. 13A to 13F are schematic views showing the steps in a Z-fold process using the sheet folding section constituted by the first and second folding sections according to the second embodiment of the present invention.

As shown in FIG. 13A, the sheet S that is discharged while the image-transferred surface t formed by the image forming apparatus A faces down passes through the punching section 40 of the postprocessing apparatus B, and is guided to the sheet folding section 50 with the image-transferred surface t facing up.

The leading end portion of the sheet S conveyed to the first folding section 51 passes between the rotating folding roller 511 and the driven roller 513 separated therefrom, and is conveyed in the sheet convey direction while being clamped between the rotating folding roller 512 and the driven roller 514 in tight contact with the roller 512. When a predetermined period of time elapses after the passage of the leading end of the sheet is detected by the sensor PS1, the rotation of the folding rollers 511 and 512 is stopped by a control means (not shown), and the sheet S is stopped at a predetermined position. This sheet stop position is the position where the leading end portion of the sheet S is located downstream of the common tangent at the nip point N of the folding rollers 511 and 512 in the sheet convey direction and has moved forward by a distance corresponding to ¼ the total length of the sheet.

Figure 13B:
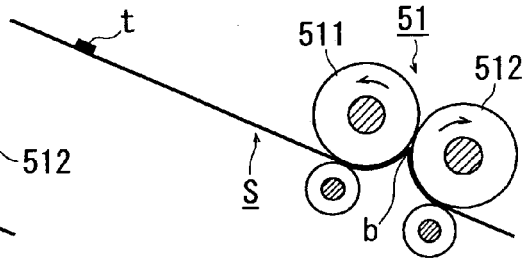

As shown in FIG. 13B, when the driven roller 513 is brought into tight contact with the folding roller 511, and the folding rollers 511 and 512 are driven in reverse, a portion of the sheet S which is located on the trailing end side in the longitudinal direction and corresponds to the ¼ position is pushed to the nip point N of the folding rollers 511 and 512 and pressurized to form the first fold b in the Z-fold process.

Figure 13C:
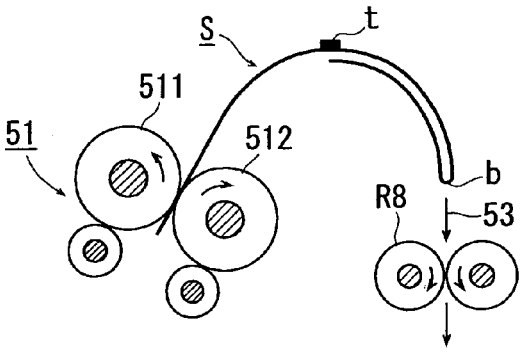

As shown in FIG. 13C, the sheet S on which the first fold b in the Z-fold process is formed is discharged while being clamped by the rotating folding rollers 511 and 512 and convey rollers R8, and moves to the second folding section 52 with the first fold b taking the lead.

Figure 13D:
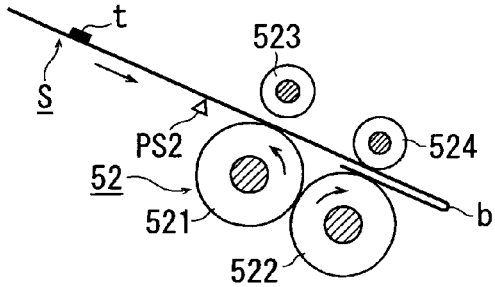

As shown in FIG. 13D, the first fold b of the sheet S conveyed to the second folding section 52 passes between the rotating driven roller 521 and the verification unit 523 separated therefrom, and passes through the clamping position between the rotating folding roller 522 and the driven roller 524 in tight contact therewith. When a predetermined period of time elapses after the passage of the leading end of the sheet is detected by the sensor PS2, the rotation of the folding rollers 521 and 522 is stopped by the control means (not shown), and the sheet S is stopped at a predetermined position.

Figure 13E:
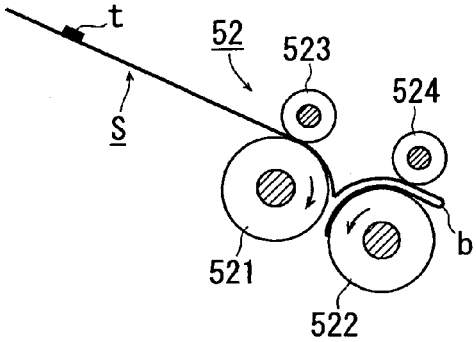

As shown in FIG. 13E, when the driven roller 523 is brought into tight contact with the folding roller 521, and the folding rollers 521 and 522 are driven in reverse, a middle portion of the sheet S in the longitudinal direction is pushed to the nip point N of the folding rollers 521 and 522 to form the second fold c in the Z-fold process. (For the sake of descriptive convenience, FIG. 13E shows the folding rollers 521 and 522 in a separate state, although they are actually in tight contact with each other.) At this time, the leading end portion of the sheet S reaches first the nip point N of the folding rollers 521 and 522, and the bent portion serving as the second fold c reaches next.

Figure 13F:
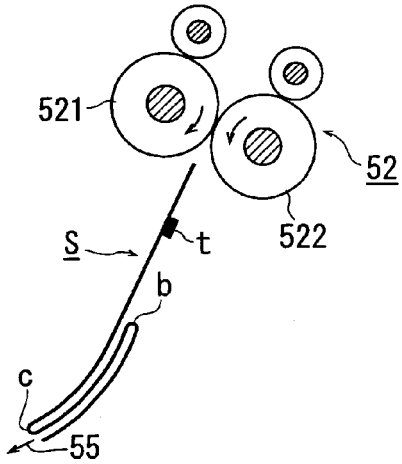

As shown in FIG. 13F, the sheet S that has undergone the Z-fold process with the second fold c being formed is discharged while being clamped between the rotating folding rollers 521 and 522 with the second fold c taking the lead, passes through the convey path 55, and is moved to the binding section 60.

(D) Center Folding Process with Image-Transferred Surface Facing Inside:

The operation steps in a center folding process with an image-transferred surface facing inside in the second embodiment will be described next with reference to FIGS. 14A to 14D.

A center folding process with an image-transferred surface facing inside for the sheet S is performed by the second folding section 52 in the sheet folding section 50 in the second embodiment.

Figure 14A:
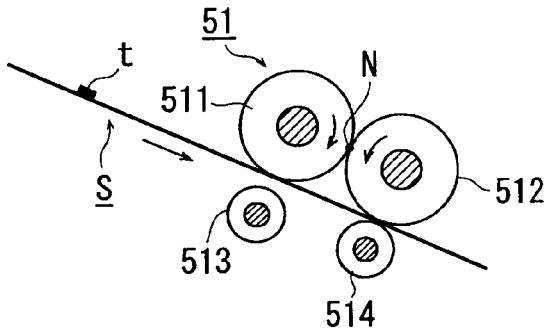
FIGS. 14A to 14D are schematic views showing the steps in a center folding process with an image-transferred surface facing inside using the sheet folding section constituted by the first and second folding sections according to the second embodiment of the present invention.

As shown in FIG. 14A, the sheet S that is discharged while the image-transferred surface t formed by the image forming apparatus A faces down passes through the punching section 40 of the postprocessing apparatus B, and is guided to the sheet folding section 50 with the image-transferred surface t facing up.

The sheet S conveyed to the first folding section 51 passes between the rotating folding roller 511 and the driven roller 513 separated therefrom, and is conveyed in the convey direction to the second folding section 52 while being clamped between the rotating folding roller 512 and the driven roller 514 in tight contact therewith.

Figure 14B:
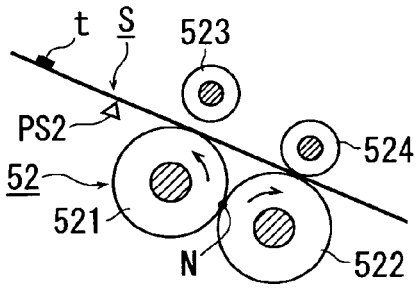

As shown in FIG. 14B, when a predetermined period of time elapses after the passage of the leading end of the sheet S, which has been conveyed to the second folding section 52, is detected by the sensor PS2, the rotation of the folding rollers 521 and 592 is stopped the sheet S is stopped at a predetermined position. This sheet stop position is the position where the leading end portion of the sheet S in the convey direction has moved forward with respect to the common tangent at the nip point N of the folding rollers 521 and 522 by a distance corresponding to ½ the total length of the sheet.

Figure 14C:
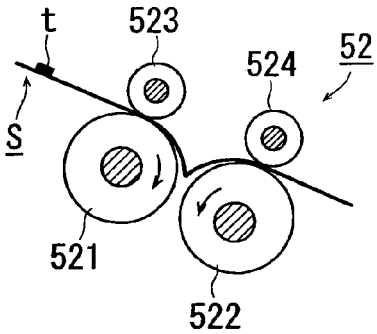

As shown in FIG. 14C, when the driven roller 523 is brought into tight contact with the folding roller 521, and the folding rollers 521 and 522 are driven in reverse, the middle portion of the sheet S in the longitudinal direction is pushed to the nip point N of the folding rollers 521 and 522 and pressurized to form the fold a in the center folding process.

Figure 14D:
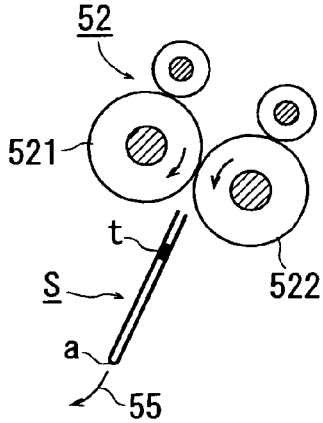

As shown in FIG. 14*d,* the sheet S which has undergone the center folding process with the fold a being formed is discharged while being clamped between the folding rollers 521 and 522, and is moved to the binding section 60 through the convey path 55 with the fold a taking the lead.

(E) Center Folding Process with Image-Transferred Surface Facing Outside:

Center folding processes with image-transferred surfaces facing outside in the first and second embodiments will be described next with reference to FIGS. 15A to 15C and FIGS. 15A to 15E, respectively.

Center folding processes with image-transferred surfaces facing outside for the sheets S are performed by the first folding sections 51 in the first and second embodiments.

Figure 15A:
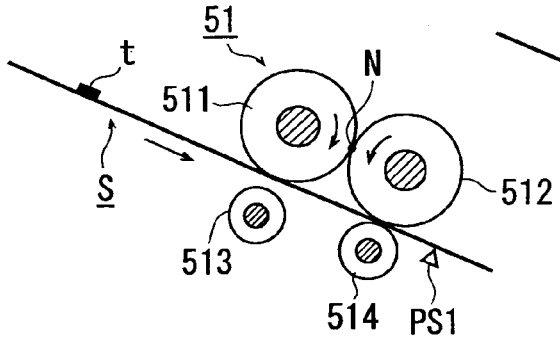
FIGS. 15A to 15E are schematic views showing the steps in a center folding process with an image-transferred surface facing outside using the sheet folding section constituted by the first and second folding sections according to the second embodiment of the present invention.
Figure 15B:
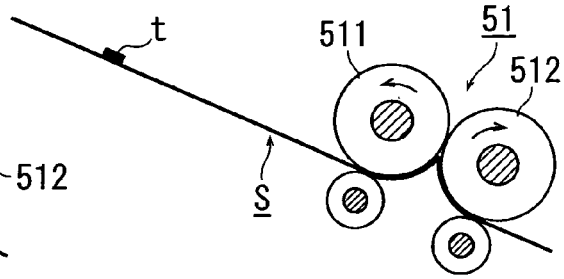
Figure 15C:
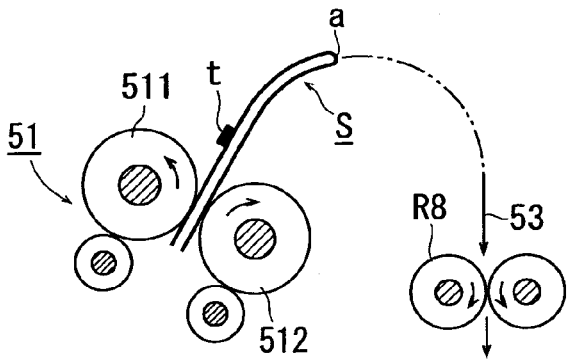

As shown in FIG. 15A of FIGS. 15A to 15C which are common to the first and second embodiments, the sheet S that is discharged while the image-transferred surface t formed by the image forming apparatus A faces down passes through the punching section 40 of the postprocessing apparatus B, and is guided to the sheet folding section 50 with the image-transferred surface t facing up.

The leading end portion of the sheet S conveyed to the first folding section 51 passes between the rotating folding roller 511 and the driven roller 513 separated therefrom, and is conveyed in the convey direction while being clamped between the rotating folding roller 512 and the driven roller 514 in tight contact therewith. When a predetermined period of time elapses after the passage of the leading end of the sheet is detected by the sensor PS1, the rotation of the folding rollers 511 and 512 is stopped by the control means (not shown), and the sheet S is stopped at a predetermined position. This sheet stop position is the position where the middle portion of the sheet S in the longitudinal direction crosses the common tangent at the nip point N of the folding rollers 511 and 512.

As shown in FIG. 15B, when the driven roller 513 is brought into tight contact with the folding roller 511, and the folding rollers 511 and 512 are driven in reverse, the middle portion of the sheet S in the longitudinal direction, i.e., the portion corresponding to the ½ position with respect to the total length of the sheet, is pushed to the nip point N of the folding rollers 511 and 512 and pressurized to form the fold a in the center folding process.

As shown in FIG. 15C, the sheet S on which the fold a in the center folding process is formed is discharged from the first folding section 51 while being clamped by the rotating folding rollers 511 and 512 and convey rollers R8, and moves to the next sheet processing section through a convey path with the fold a taking the lead. In the sheet folding section 50 in the first embodiment, since the second folding section 52 is not provided, the sheet S which has undergone the center folding process with the image-transferred surface facing outside is moved to the binding section 60 through the convey paths 55 and 56 (see FIG. 6A). In contrast, in the sheet folding section 50, the sheet S is moved to the second folding section 52.

Figure 15D:
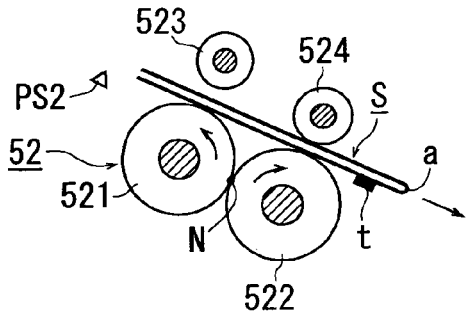

In the second embodiment, as shown in FIG. 15D, the sheet S conveyed to the second folding section 52 passes between the rotating folding roller 521 and the driven roller 523 separated therefrom, and passes through the clamping position between the rotating folding roller 522 and the driven roller 524 in tight contact therewith.

Figure 15E:
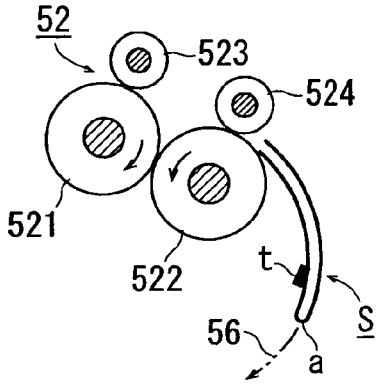

As shown in FIG. 15E, the sheet S which has undergone the center folding process with the fold a being formed is discharged from the second folding section 52 while being clamped between the rotating folding roller 521 and the driven roller 524, and is moved to the binding section 60 through the convey path 56 with the fold a taking the lead (see FIG. 6B).

Figure 16A:
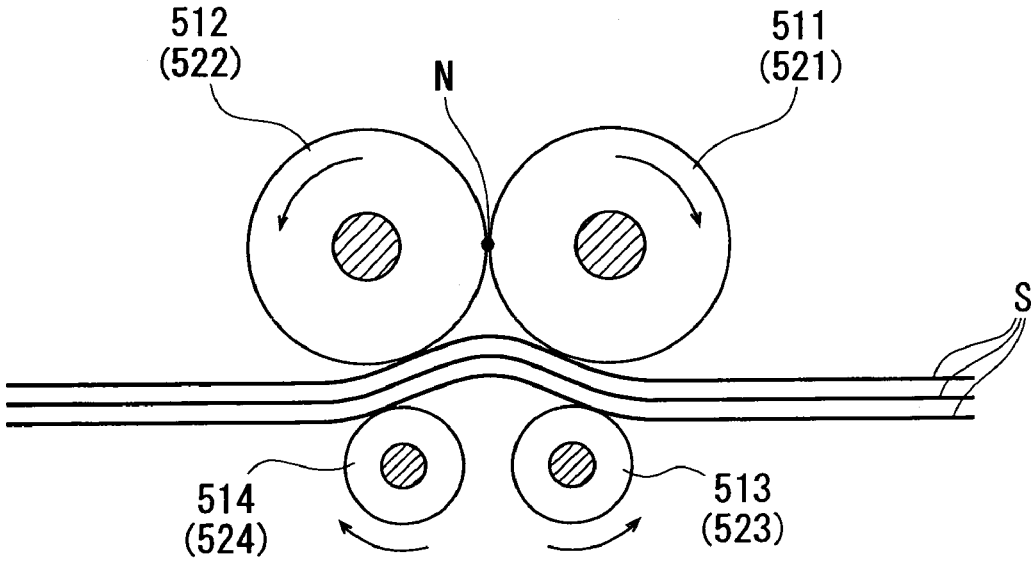
FIGS. 16A and 16B are views showing other steps in a folding process using the first folding section.
Figure 16B:
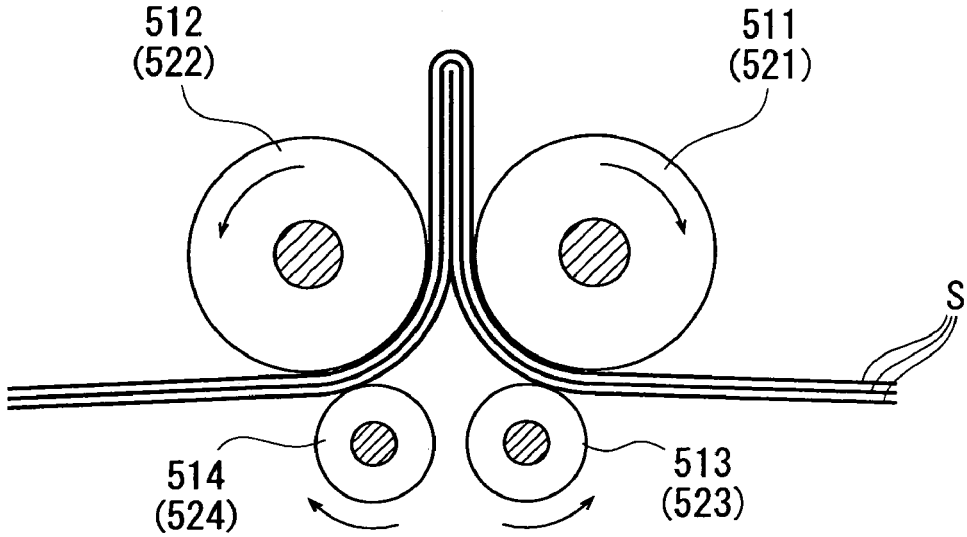

(F) Center Folding Process for Bundle of Sheets Stacked on Each Other:

As shown in FIGS. 16A and 16B, the first folding section 51 can perform a center folding process for a bundle of sheets stacked on each other. This is because, according to the first folding section 51 having the arrangement shown in FIG. 9C, the driving loads are reduced by the ball bearings 535 and 534 respectively attached to the driven rollers 513 and 514. As is obvious, if the second folding section 52 has an arrangement like the one shown in FIG. 9C, the second folding section 52 can also perform a center folding process for a bundle of sheets stacked on each other.

(G) Straight Paper Discharge:

The sheet S guided from the image forming apparatus A to the postprocessing apparatus B and punched by the punching section 40 does not pass through the convey path to the first folding section 51 and second folding section 52 of the sheet folding section 50 if the above folding processes are not performed. In this case, as shown in FIGS. 6A and 6B, the sheet S is caused to branch by the convey path switching means G3 to be sent to the binding section 60 through the bypass convey path 57 constituted by convey rollers R4, R5, R6, and R7 located downstream of the first folding section 51 and second folding section 52.

The relationship between the folding rollers 511 and 512 and the driven rollers 513 and 514 will be described in detail next with reference to FIGS. 17 to 19. This applies to the relationship between the folding rollers 521 and 522 and the driven rollers 523 an 524.

Figure 17:
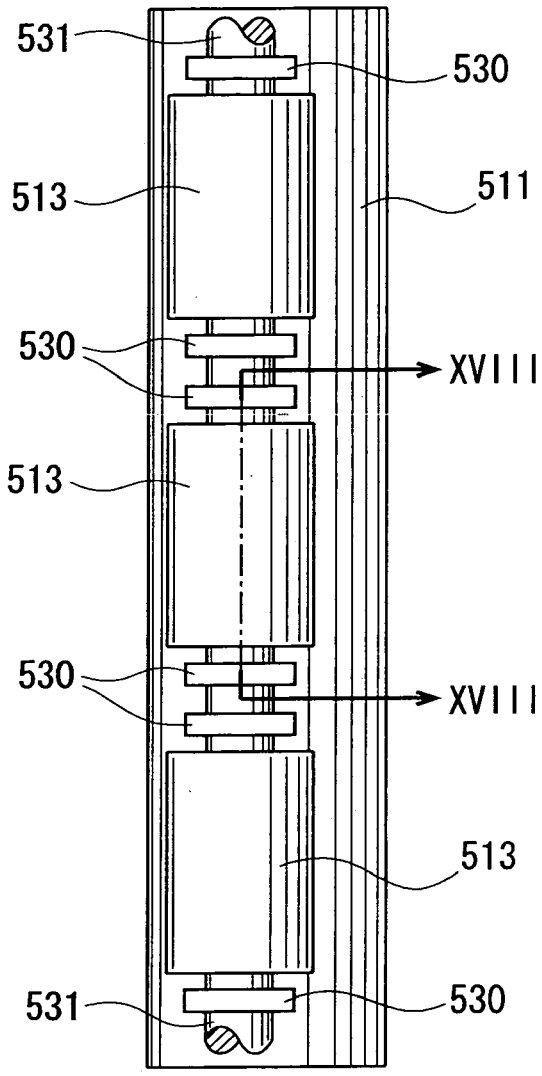
FIG. 17 is a plan view of a combination of a folding roller and driven rollers as seen from below.

FIG. 17 is a view of the folding roller 511 and driven rollers 513 in FIGS. 9A to 9C as seen from below. The folding roller 511 is a roller longer than the width of the sheet S. The driven rollers 513 each having a length smaller than the sheet width are attached to the folding roller 511, and support portions 530 are mounted at portions near the two ends of each driven roller 513. The shaft 531 extends through these driven rollers 513 and support portions 530. Referring to FIG. 17, the single shaft 531 extends through all the driven roller 513. However, different shafts may extend through the driven rollers 513, respectively. In this case, the axes of the respective shafts need to be aligned with each other.

Figure 18:
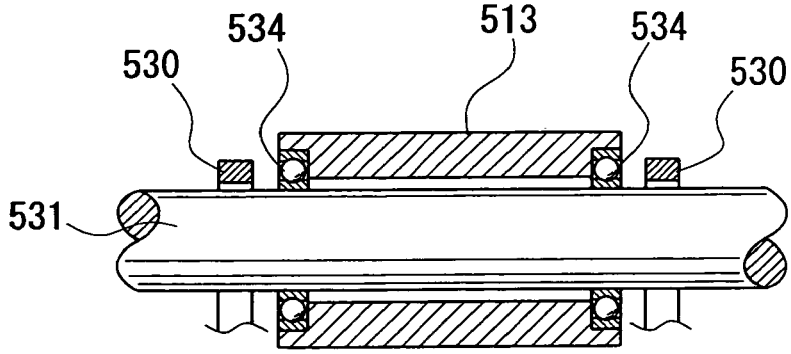
FIG. 18 is a sectional view taken along a line XVIII—XVIII of a driven roller in FIG. 17.

FIG. 18 is a sectional view taken along a line XVIII—XVIII of the driven roller 513 in FIG. 17. The driven roller 513 has a cylindrical shape. The ball bearings 534 are mounted on the two ends of the driven roller 513 to allow the driven rollers 513 to be rotatably mounted on the driven roller 513. The shaft 531 is fixed to the support portions 530. Referring to FIG. 18, the ball bearings 534 are attached to the driven roller 513. However, the ball bearings 534 may be attached to the support portions 530. In this case, the driven roller 513 is fixed to the shaft 531, and the shaft 531 and driven roller 513 rotate together. When the tight contact between the folding roller 511 and the driven roller 513 is to be released, the shaft 531, driven roller 513, ball bearings 534, and support portions 530 all separate from the folding roller 511.

One driven roller 514 is always pressed against the folding roller 512 with elastic members such as springs, whereas the other driven roller 513 is pressed against the folding roller 511 with springs or the like and can be detached from the folding roller 511 with solenoids.

Figure 19:
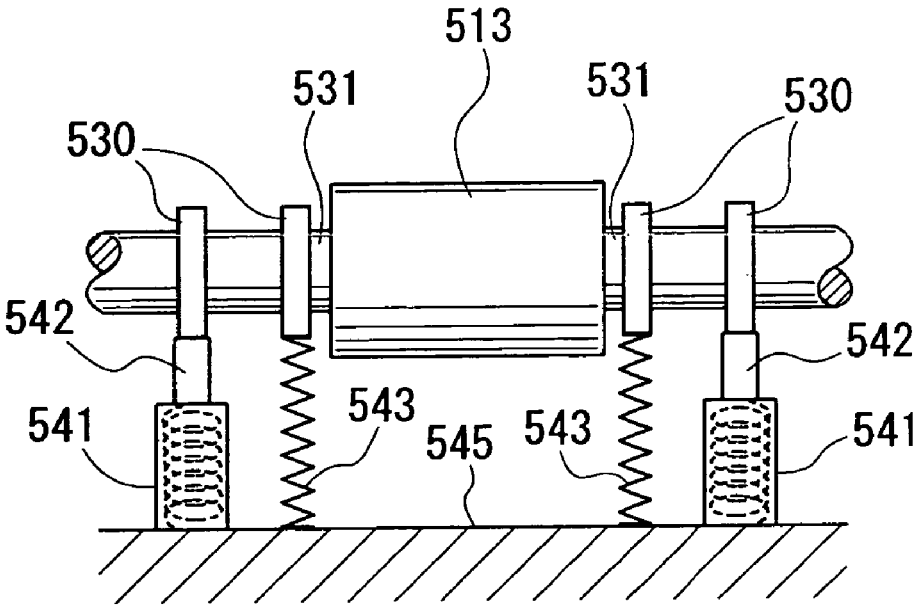
FIG. 19 is a schematic view showing support portions for a driven roller.

FIG. 19 is a schematic view of the structure of the support portions 530 which support the driven roller 513. The driven roller 513 is pressed against the folding roller 511 with springs 543 and solenoids 541 which support the support portions 530, and the solenoids 541 are fixed to a frame 545. The springs 543 are mounted on the frame 545 When the solenoids 541 are energized, rods 542 move downward in FIG. 19, and the support portions 530 and driven roller 513 also move downward accordingly and separate from the folding roller 511. When the solenoids 541 are de-energized, the rods 542 return to their original positions with the force of the springs. As a consequence, the driven roller 513 is brought into tight contact with the folding roller 511 again. Although the solenoids are used in the arrangement shown in FIG. 19, cams, linear motors, or the like can be used in place of the solenoids. For the driven roller 514 that is always in tight contact with the folding roller 512, no solenoid is required. The driven roller 514 is pressed against the folding roller 512 with springs or the like (not shown) which are directly mounted on the frame 545.

A folding method according to the present invention will be described finally with respect to FIGS. 20A to 20C.

As has been described above, a Z-fold process can be performed by the sheet folding section 50 provided in the postprocessing apparatus B in the following manner. First of all, the first folding section 51 forms a fold on the sheet S at a position which is located on the leading end side in the convey direction at a position corresponding to ¼ the total length of the sheet. The second folding section 52 then forms a fold on the sheet S at the middle position in the total length of the sheet.

A folding method in the second folding section 52, which prevents multiple folding, will be described below with reference to FIGS. 20A to 20C.

Figure 20A:
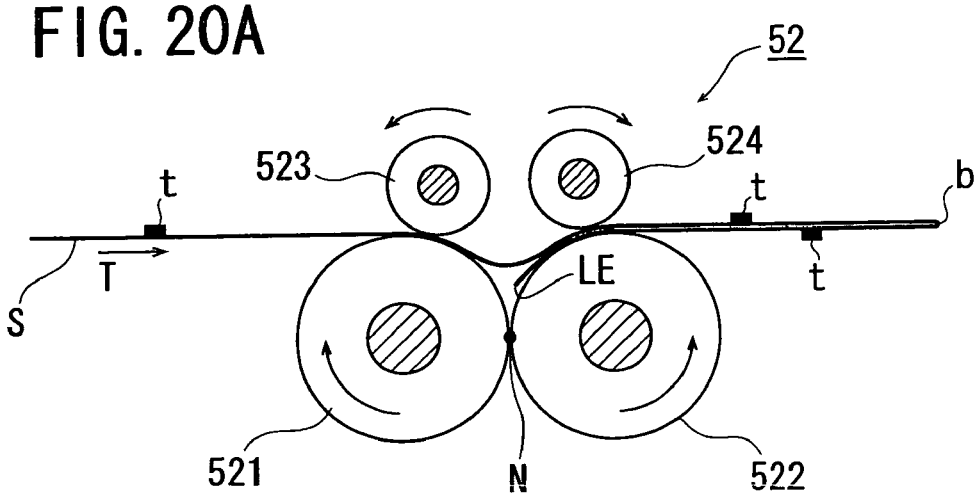
FIGS. 20A to 20C are views for explaining the steps in a folding method according to the present invention.

The sheet S on which a flap S' is formed by the first folding section 51 is conveyed to the second folding section 52 in the direction indicated by an arrow T in FIG. 20A. With a leading end position detection means such as a sensor SE, the sheet S is accurately stopped when a sheet portion corresponding to ½ the total length of the sheet is conveyed to a position immediately below the nip point N of the folding rollers 521 and 522. The driven roller 523 is then brought into tight contact with the folding roller 521, and the folding roller 521 is rotated in the direction indicated by the arrow in FIG. 20A. As a consequence, the sheet S keeps bending toward the folding rollers 521 and 522. The flap S' folded back by the first folding section 51 comes into contact with the folding roller 522, and a leading end LE is nipped between the folding roller 522 and the driven roller 524. However, since the leading end LE is not nipped between the folding roller 521 and the driven roller 523, it passes through the nip point N early than the bent portion.

Figure 20B:
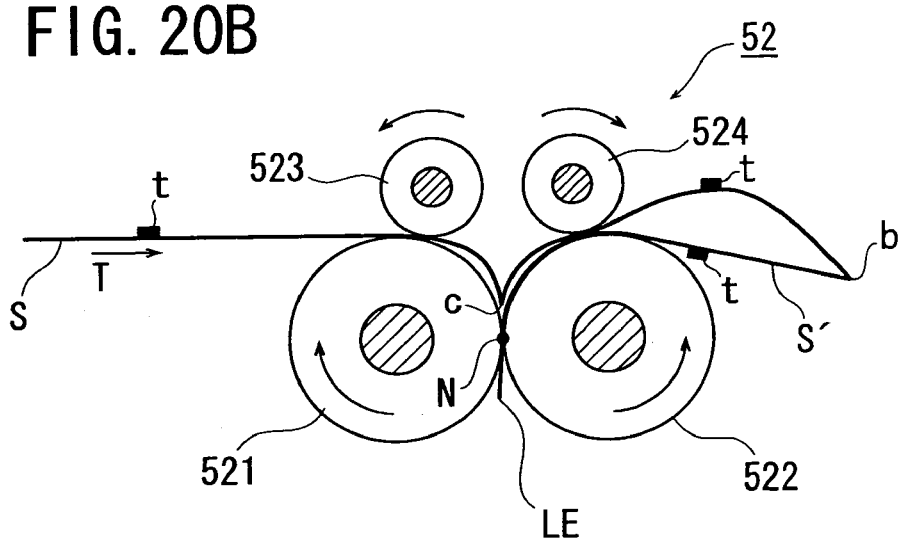
Figure 20C:
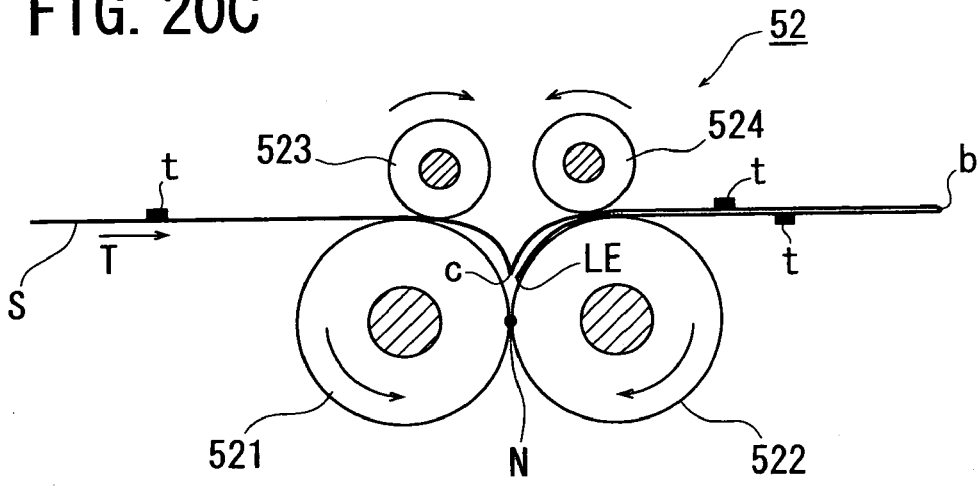

As the folding roller 521 is kept rotated, the bent portion passes through the nip point N after the leading end LE, thereby forming the second fold c, as shown in FIG. 20B. At this point of time, the rotation of the folding roller 521 is temporarily stopped. As shown in FIG. 20C, then, the folding roller 521 is rotated in reverse to move the leading end LE and the fold c in reverse in the sheet convey direction, thereby bringing them back from the nip point N. As a consequence, the leading end LE is aligned with the second fold c. When the folding roller 521 is rotated in the direction indicated by the arrow in FIG. 20A again, the leading end LE and second fold c simultaneously pass through the nip point N.

FIG. 8D shows the Z-fold process that is Z-folded in this manner. The fold b is formed by the first folding section 51. The fold c is formed by the second folding section 52.

The sheet postprocessing apparatus of the present invention has been described above as a sheet postprocessing apparatus connected to the main body of a copying machine. Obviously, however, the present invention can also be applied to sheet postprocessing apparatuses to be used while being connected to image forming apparatuses such as a printer, a facsimile apparatus, and a composite apparatus.

What is claimed is:

1. A sheet postprocessing apparatus which executes postprocessing including a folding process for a sheet on which an image is transferred/formed by an image forming apparatus, comprising a sheet folding section having first and second folding sections which are arranged in series in a sheet convey direction to execute the folding process for the sheet, the first folding section having a first folding path for folding the sheet and a first through path for not folding, and the second folding section having a second folding path for folding the sheet and a second through path for not folding, wherein said sheet folding section is configured such that the first folding section performs a first folding process in a Z-fold process, a first folding process in an internal three-fold process, and a center folding process, wherein the second folding section performs a second folding process in the Z-fold process, a second folding process in the internal three-fold process, and wherein each of the first and second folding sections comprises a pair of folding rollers which rotate in tight contact with each other, an upstream driven roller which is detachably brought into tight contact with one of the pair of folding rollers to be driven/rotated, a downstream driven roller which is brought into tight contact with the other of the pair of folding rollers to be driven/rotated, and a sensor which detects passage of a leading end portion of a sheet guided into the folding section.

2. A sheet postprocessing apparatus which executes postprocessing including a folding process for a sheet on which an image is transferred/formed by an image forming apparatus, comprising a sheet folding section having first and second folding sections which are arranged in series in a sheet convey direction to execute the folding process for the sheet, the first folding section having a first folding path for folding the sheet and a first through path for not folding, and the second folding section having a second folding path for folding the sheet and a second through path for not folding, wherein said sheet folding section is configured such that the first folding section performs a first folding process in a Z-fold process, a first folding process in an internal three-fold process, and a center folding process, wherein the second folding section performs a second folding process in the Z-fold process, a second folding process in the internal three-fold process, wherein the sheet discharged from the image forming apparatus is guided to said sheet postprocessing apparatus, with the image-transferred surface facing down, while being reversed back to front with respect to the sheet when the image is formed thereon, the first folding section folds the sheet with the image-transferred surface facing outside, and the second folding section folds the sheet with the image-transferred surface facing inside, and wherein each of the first and second folding sections comprises a pair of folding rollers which rotate in tight contact with each other, an upstream driven roller which is detachably brought into tight contact with one of the pair of folding rollers to be driven/rotated, a downstream driven roller which is brought into tight contact with the other of the pair of folding rollers to be driven/rotated, and a sensor which detects passage of a leading end portion of a sheet guided into the folding section.

3. An apparatus according to claim 1, wherein the centers of the two driven rollers are located inside the centers of the pair of folding rollers.

4. An apparatus according to claim 2, wherein the centers of the two driven rollers are located inside the centers of the pair of folding rollers.

5. An apparatus according to claim 1, wherein the two driven rollers are mounted on a support shaft through rolling bearings, respectively.

6. An apparatus according to claim 2, wherein the two driven rollers are mounted on a support shaft through rolling bearings, respectively.

7. An apparatus according to claim 3, wherein the two driven rollers are mounted on a support shaft through rolling bearings, respectively.

8. An apparatus according to claim 7, wherein the first folding section, the binding section, and the second folding section are sequentially arranged in series in the sheet convey direction.

9. An apparatus according to claim 4, wherein the two driven rollers are mounted on a support shaft through rolling bearings, respectively.

10. A sheet postprocessing apparatus which executes postprocessing including a folding process for a sheet on which an image is transferred/formed by an image forming apparatus, comprising a sheet folding section having first and second folding sections which are arranged in series in a sheet convey direction to execute the folding process for the sheet, the first folding section having a first folding path for folding the sheet and a first through path for not folding, and the second folding section having a second folding path for folding the sheet and a second through path for not folding, wherein said sheet folding section is configured such that the first folding section performs a first folding process in a Z-fold process, a first folding process in an internal three-fold process, and a center folding process, wherein the second folding section performs a second folding process in the Z-fold process, a second folding process in the internal three-fold process, and wherein said sheet postprocessing apparatus includes a convey path on which the sheet passes through said sheet folding section constituted by the first and second folding sections and a bypass convey path on which the sheet does not pass through said sheet folding section.

11. An apparatus according to claim 10, wherein the sheet which has passed the bypass convey path is conveyed to a sheet mount base disposed downstream of said sheet folding section in the sheet convey direction.

12. A sheet postprocessing apparatus which executes postprocessing including a punching process, a folding process, and a binding process midway along a sheet convey path for a sheet on which an image is transferred/formed by an image forming apparatus and which is discharged from the image forming apparatus, comprising a sheet folding section including first and second folding sections which perform folding processes for a sheet discharged from the image forming apparatus, a binding section which is disposed on a sheet convey path located downstream of the first folding section and upstream of the second folding section in a sheet convey direction, on which a sheet bundle constituted by a plurality of sheets is stacked, aligned, and subjected to a binding process, and controller for controlling driving operation of the first and second folding sections, wherein the first folding section includes a first pair of folding rollers which rotate in tight contact with each other, an upstream driven roller which is detachably brought into tight contact with one of the pair of folding rollers to be driven/rotated, a downstream driven roller which is brought into tight contact with the other of the pair of folding rollers to be driven/rotated, and a sensor which detects passage of a leading end portion of a sheet guided into the first folding section, the second folding section includes a folding plate member which can be moved in a direction perpendicular to a sheet surface, and a second pair of folding rollers which rotate in tight contact with each other, and when an internal three-fold process is set for a sheet, the controller performs control to convey the sheet while releasing tight contact between an upstream driven roller which opposes the upstream folding roller of the first pair of folding rollers of the first folding section, stop the sheet at a first predetermined position on the basis of a sheet leading end passage detection signal obtained by the sensor, bring the upstream driven roller into tight contact with the upstream folding roller, form a first fold by driving the first pair of folding rollers in reverse, and form a second fold by moving the folding plate member of the second folding section on a sheet surface so as to push a second predetermined position of the sheet having the first fold to a nip point of the pair of folding rollers, and driving the pair of rollers in reverse.

13. A folding method for a Z-fold process method using first and second folding sections of a sheet postprocessing apparatus including a pair of folding rollers which are in tight contact with each other to form a nip point and rotate in predetermined opposite directions, an upstream driven roller which is brought into tight contact with one of the pair of folding rollers to be driven/rotated, and a downstream driven roller which is brought into tight contact with the other of the pair of folding rollers to be driven/rotated, comprising:

the step of forming a first fold using the first folding section;

the step of buckling the sheet and making the sheet be caught between the pair of folding rollers at the nip point by rotating the pair of folding rollers in the predetermined directions while the sheet on which the first fold is formed is clamped between the pair of folding rollers and the respective driven rollers and a leading end of a flap portion of the sheet is in contact with a surface of one roller, thereby forming a second fold;

the step of bringing back the second fold caught at the nip point and the leading end of the flap portion of the sheet from the nip point to a nip point releasing position by reversing the pair of rollers in directions opposite the predetermined directions; and the step of causing the sheet with the second fold and the leading end of the flap portion of the sheet being in tight contact with each other to pass through the nip point again by rotating the pair of folding rollers in the predetermined directions again.

14. A method according to claim 13, wherein the centers of the upstream and downstream driven rollers are located inside the centers of the pair of folding rollers.

* * * * *